US008869545B2

(12) United States Patent
Chen et al.

(10) Patent No.: US 8,869,545 B2
(45) Date of Patent: Oct. 28, 2014

(54) DEFROSTING A HEAT EXCHANGER IN A HEAT PUMP BY DIVERTING WARM REFRIGERANT TO AN EXHAUST HEADER

(71) Applicant: Nordyne LLC, O'Fallon, MO (US)

(72) Inventors: Jie Chen, St. Charles, MO (US); Jacob J. Rede, Dardenne Prairie, MO (US); David L. Koesterer, Belleville, IL (US); Craig A. Thomas, O'Fallon, MO (US)

(73) Assignee: Nordyne LLC, O'Fallon, MO (US)

( * ) Notice: Subject to any disclaimer, the term of this patent is extended or adjusted under 35 U.S.C. 154(b) by 0 days.

(21) Appl. No.: 14/044,786

(22) Filed: Oct. 2, 2013

(65) Prior Publication Data

US 2014/0026601 A1 Jan. 30, 2014
US 2014/0196484 A9 Jul. 17, 2014

Related U.S. Application Data

(63) Continuation of application No. PCT/US2013/042266, filed on May 22, 2013, which is a continuation-in-part of application No. 13/477,973, filed on May 22, 2012.

(51) Int. Cl.

| | |
|---|---|
| ***F25B 41/00*** | (2006.01) |
| ***F25D 21/00*** | (2006.01) |
| ***F25B 47/02*** | (2006.01) |
| ***F25D 21/06*** | (2006.01) |
| ***F25B 49/02*** | (2006.01) |
| *F25B 13/00* | (2006.01) |

(52) U.S. Cl.

CPC ..... *F25B 47/025* (2013.01); *F25B 2600/2501* (2013.01); *F25B 2341/0662* (2013.01); *F25B 13/00* (2013.01); *F25B 2400/0409* (2013.01); *F25D 21/002* (2013.01); *F25B 2313/02741* (2013.01); *F25D 21/06* (2013.01); *F25B 49/02* (2013.01)

USPC ..... 62/81; 62/151; 62/234; 62/324.6; 62/278

(58) Field of Classification Search

USPC ..... 62/81, 151, 234, 324.1, 324.6, 278, 62/222, 513; 165/297, 298, 204, 103

See application file for complete search history.

(56) References Cited

U.S. PATENT DOCUMENTS 2,954,680 A 10/1960 Ruff
3,218,819 A 11/1965 Crotser (Continued)

FOREIGN PATENT DOCUMENTS

JP H028668 A 1/1990
JP H1082569 A 3/1998

(Continued)

OTHER PUBLICATIONS

Merriam-Webster definition of regulate.*

(Continued)

*Primary Examiner* — Cheryl J Tyler
*Assistant Examiner* — David Teitelbaum
(74) *Attorney, Agent, or Firm* — Allan W. Watts; Bryan Cave LLP

(57) ABSTRACT

Heat pumps with improved defrost cycles and methods of defrosting heat exchangers, for example, having microchannel outdoor heat exchangers. A heat exchanger has three types of connection points that are used during a defrost cycle. Two connection points are used to deliver hot refrigerant gas to the heat exchanger and one connection point is where refrigerant exits the heat exchanger. Two of the connection points are at the same header and during at least part of the defrost cycle, at least part of the hot refrigerant gas is passed through that header without passing through any cross tubes of the heat exchanger. A defrost valve in a refrigerant conduit opens during the defrost cycle to deliver hot refrigerant gas to the connection point on the header. In a number of embodiments, the defrost valve is open only during a portion of the defrost cycle.

23 Claims, 6 Drawing Sheets

(56) References Cited

U.S. PATENT DOCUMENTS

| | | | |
|---|---|---|---|
| 3,534,806 | A | 10/1970 | Rodgers |
| 4,407,137 | A | 10/1983 | Hayes |
| 4,625,524 | A | 12/1986 | Kimura |
| 5,226,285 | A | 7/1993 | Dankowski |
| 6,708,510 | B2 | 3/2004 | Sulc |
| 7,171,817 | B2 | 2/2007 | Birgen |
| 8,006,506 | B2 | 8/2011 | Park |
| 8,235,101 | B2 | 8/2012 | Taras |
| 2008/0264097 | A1 | 10/2008 | Ishizaka |
| 2010/0071868 | A1 | 3/2010 | Reifel |

FOREIGN PATENT DOCUMENTS

| | | | |
|---|---|---|---|
| JP | H10292960 | A | 11/1998 |
| JP | 2009097805 | A | 5/2009 |

OTHER PUBLICATIONS

Merriam-Webster definition of regualte—Dec. 22, 2005.*

Hantz, D., Guylas, G., Bensafi, A. & Mercer, K. B., Demonstration of a Microchannel Heat Exchanger for Operation in a Reversible Heat Pump System, Retrieved from http://www.cnasystem.cn/images/upfile/2011071852111733.pdf Jul. 18, 2011.

Hong, T., Moaellem, E., Cremaschi, L., and Fisher, D.E., 2012. Measurements of Frost Growth on Louvered Folded Fins of Microchannel Heat Exchangers Part 1: Experimental Methodology. ASHRAE Transactions. 118(1):1101-1115. Jan. 1, 2012.

Hrnjak, P., Zhang, P., & Rennels, Effect of louver angle on performance of heat exchanger with serpentine fins and flat tubs in frosting, International Refrigeration and Air Conditioning Conference at Purdue (15 pgs) Jul. 16, 2012.

Padhmanabhan, S., Cremaschi, L., Fisher, D.E., and Knight, J., Comparison of Frost and Defrost Performance Between Microchannel Coil and Fin-and-Tube Coil for Heat Pump Systems (2008). International Refrigeration and Air Conditioning conference, Paper 869 Jul. 14, 2008.

Stafford, L., Schaffart, R., Modine Will Receive the Cooling Innovation Award for its PF2 Micro Channel Technology at the World's Largest HVAC&R Trade Show Jan. 17, 2006.

Zhang, P., Hrnjak, P.S., Air-Side Performance of a Parallel Fin Parallel Flow (PF2) Heat Exchanger in Sequential Frosting (2008). international Refrigeration and Air Conditioning conference. Paper 967. http://docs.lib.purdue.edu/iracc/967 Jul. 14, 2008.

Liquidity and Capital Resources for Modine Manufacturing Co. http://google.brand.edgar-online/EFX_dll/EDGARpro.dll?FetchFiling (Apr. 25, 2013).

ISR and Written Opinion for Corresponding Int'l Application No. PCT/US2013/042266 dated May 22, 2013.

* cited by examiner

DEFROSTING A HEAT EXCHANGER IN A HEAT PUMP BY DIVERTING WARM REFRIGERANT TO AN EXHAUST HEADER

RELATED PATENT APPLICATIONS

This patent application claims priority to international patent application serial number PCT/US2013/042266, filed under the Patent Cooperation Treaty (PCT) on May 22, 2013, titled: Defrosting A Heat Exchanger In A Heat Pump By Diverting Warm Refrigerant To An Exhaust Header, which claims priority to U.S. non-provisional patent application Ser. No. 13/477,973, filed on May 22, 2012, titled: Heat Pump With Improved Defrost Cycle and Method of Defrosting a Heat Exchanger. This patent application is also related to U.S. non-provisional patent application Ser. No. 13/572,116, filed on Aug. 10, 2012, titled: Method And Apparatus For Defrosting A Microchannel Heat Exchanger In A Heat Pump By Diverting Warm Refrigerant To An Exhaust Header, which also claims priority to U.S. non-provisional patent application Ser. No. 13/477,973. All of these related patent applications have the same inventors as the current patent application and the same assignee, and the contents of all of these related patent applications are incorporated herein by reference.

FIELD OF THE INVENTION

This invention relates to defrost cycles for heat pumps and methods of defrosting heat exchangers. Particular embodiments concern heat pumps, defrost cycles, and defrost methods for heat pumps with microchannel outdoor coils.

BACKGROUND OF THE INVENTION

Heat pump HVAC units have been used for some time to heat and cool spaces that people occupy such as the interior of buildings. Heat pumps have also been used for other purposes such as heating water and providing heat for industrial processes. Heat pumps are typically more efficient than alternative heat sources, such as electrical resistance heating, because heat pumps extract heat from another source, such as the environment, in addition to providing heat produced from the consumption of electrical power. As a result, heat pumps often reduce energy consumption in comparison with alternatives.

More broadly speaking, a heat pump is a machine or device that transfers thermal energy from one location, at a lower temperature, to another location, which is at a higher temperature. Accordingly, heat pumps move thermal energy in a direction opposite to the direction that it normally flows. Thus, air conditioners and freezers are also types of heat pumps, as used herein. Some types of heat pumps are dedicated to refrigeration only, some types are dedicated to heat only, and some types perform both functions, for instance, depending on whether heating or cooling is needed at the time. Further, in some applications, the heating and the cooling are both put to beneficial use at the same time.

In many applications, heat pumps extract heat from air, such as outdoor air, when a heat pump is being used to provide heat. In other examples, heat pumps extract heat from air that is being cooled such as air in a freezer when the heat pump is being used to cool the freezer. When a heat pump is used to extract heat from outdoor air, if the outdoor air temperature is close to or below freezing, moisture in the air can be deposited onto the outdoor air heat exchanger of the heat pump forming frost on the heat exchanger. The same may occur on a heat exchanger used to cool a freezer or refrigerator, as other examples. Build up of frost on the heat exchanger can interfere with heat transfer from the air to the refrigerant in the heat pump. Specifically, frost can insulate the heat exchanger, or can even block air flow through the heat exchanger. To address this problem, heat pumps have been operated in a defrost mode during a brief defrost cycle, during which the heat exchanger is warmed to melt the frost.

For example, heat pumps that are used in an HVAC application to heat and cool a building, when being used in a heating mode, may interrupt the heating mode periodically to run a defrost cycle. In the defrost cycle, the heat pump may be operated in the cooling mode, except without the outdoor air fan running. In this mode, hot refrigerant gas is delivered to the outdoor air heat exchanger heating the heat exchanger and melting frost that has accumulated on the heat exchanger. After the defrost cycle has been completed, the heat pump returns to the heating mode until another defrost cycle is initiated.

In recent years, microchannel heat exchangers have replaced other types of heat exchangers in various applications including automobile air conditioning. Microchannel heat exchangers typically have a first header, a second header, and multiple cross tubes extending from the first header to the second header. See U.S. patent application Ser. No. 12/561,178, Publication 2010/0071868, for example. Usually, each of the multiple cross tubes directly connects at one end to the first header and each of the multiple cross tubes directly connects at the other end to the second header. Moreover, in microchannel heat exchangers, the first header is often parallel to the second header, the multiple cross tubes are often parallel to each other, the headers are often perpendicular to the cross tubes, and the multiple cross tubes typically each include multiple contiguous parallel refrigerant passageways therethrough (e.g., extending from the first header to the second header). These refrigerant passageways are typically smaller than refrigerant passageways in prior heat exchanger designs (e.g., tube and fin heat exchangers), which is the origin of the name "microchannel". Furthermore, most microchannel heat exchangers include multiple fins between the cross tubes, and the fins are typically bonded to the cross tubes. Microchannel heat exchangers generally offer a relatively high effectiveness relative to their cost and the restriction that they provide, in comparison with prior heat exchangers used for similar purposes. Microchannel heat exchangers generally also require less refrigerant, in comparison with prior heat exchangers used for similar purposes, and are also generally smaller and lighter in weight than alternative heat exchangers providing equivalent performance.

Microchannel heat exchangers have also been used in place of other types of heat exchangers in residential air conditioning units. In heat pump HVAC units, however, it has been found that microchannel heat exchangers do not defrost as well as certain prior heat exchangers. For example, if during a defrost cycle, hot refrigerant gas is introduced into the first header and travels though the cross tubes to the second header, the second header and the ends of the cross tubes that are connected to the second header often have not gotten warm enough to melt all of the frost there within a desired amount of time. As a result, frost or ice may remain on this portion of the heat exchanger after the defrost cycle is ended, or it may be necessary to extend the defrost cycle and remain in the defrost mode for a longer time.

Microchannel heat exchangers have been know for years to offer performance advantages, particularly relative to cost, size, weight, and the amount of refrigerant that is needed, in comparison with other types of heat exchangers. A long-felt need has existed to use microchannel heat exchangers in HVAC applications, but attempts to use microchannel heat exchangers for outdoor air heat exchangers in heat pumps have failed due to problems defrosting this type of heat exchangers. Others have taken many different approaches to resolving these problems, but none of their efforts have been successful and no heat pumps have been marketed that use a microchannel heat exchanger for the outdoor air heat exchanger.

U.S. Pat. No. 4,407,137 (Hayes) concerns a method and apparatus for defrosting a heat exchanger (50) having multiple rows (52 and 54) of cross tubes (Abstract, FIGS. 1 and 2, col. 3, lines 7-31). In Hayes, a solenoid valve (92) is opened during the defrost cycle to allow the hot refrigerant gas to bypass the second row (54) of the heat exchanger to the first row (52) of the heat exchanger to better defrost the first row where most of the frost typically accumulates in the tube and fin type of heat exchanger shown (col. 4, lines 45-52). Hayes uses three vertical headers on one side of the heat exchanger (FIG. 1 and col. 3, lines 25-26), which include an intermediate header (70) connected with feeder tubes (64 and 66) to the two rows (52 and 54) of cross tubes of the heat exchanger (50). The intermediate header is connected to each of the other headers (60 and 80) by horizontal cross tubes (rows 52 and 54) that pass through vertical fins (58, FIG. 1) and by feeder tubes (62, 64, 66, and 68). In Hayes, the refrigerant delivered to the second header through solenoid valve 92 and refrigerant conduit (hot gas bypass line) 90, passes through the cross tubes of coil row 52 before reaching header 60 (analogous to the second header of various embodiments herein). Hayes does not teach or suggest passing refrigerant through a header (e.g., 60, 70, or 80) of heat exchanger 50 without also passing that refrigerant through the cross tubes of coil row 52.

In various applications, in the defrost mode, as hot refrigerant gas is delivered to the heat exchanger, a portion of this heat will be transferred to the environment surrounding the heat exchanger. In particular, heat may be transferred via convection to air around the heat exchanger. Heat that is transferred to the air is not available or is less available to defrost the heat exchanger, especially for portions of the heat exchanger that are physically below the location where the heat is transferred to the air. As mentioned, in prior heat pumps, the outdoor air fan was typically turned off during the defrost cycle, which avoids heat loss to the surrounding air through forced convection. Natural convection still occurs, however, under such circumstances, carrying the hot air and heat upward where the heat is lost to the environment. For example, air heated by the heat exchanger can travel upward through the fan, pushed up by buoyancy forces from denser colder air, and colder air tends to flow through the heat exchanger to replace the warm air that has risen. This colder air flowing through the heat exchanger continues to cool the heat exchanger, cooling the refrigerant and taking heat away from the intended purpose of melting the frost. As a result, frost has remained on the heat exchanger, particularly on the lower portion of the heat exchanger, after a defrost cycle is completed, and it has been necessary to extend the defrost cycle and remain in the defrost mode for a longer time in order to defrost a heat exchanger completely or adequately.

Extending the defrost cycle in HVAC applications, for example, is undesirable because the heat pump delivers cold air to the space during the defrost cycle, which may lower the temperature in the space significantly below the thermostat set point temperature, may cause a cold draft and discomfort to the occupants of the space during the defrost mode, may cause the occupants of the space to believe that the heat pump is not working properly, or a combination thereof, for instance. Extension of defrost cycles and less effective defrost cycles may be undesirable in other applications (besides HVAC) as well, among other things, because heating or cooling is unavailable during the defrost cycle and because energy used during the defrost cycle does not contribute to the heating or cooling that is intended to be produced by the heat pump.

As a result, needs or potential for benefit or improvement exist for defrost cycles for heat pumps and methods of defrosting heat exchangers of heat pumps that are more effective, that direct hot refrigerant gas to areas of the heat exchanger that otherwise would not get warm enough, that take less time to complete, that work effectively with microchannel heat exchangers, or a combination thereof, as examples. In addition, needs or potential for benefit or improvement exist for defrost cycles for heat pumps, and methods of defrosting heat exchangers, that reduce the amount of heat loss to the air from the heat exchanger during the defrost cycle, that reduce natural convection during the defrost cycle, or a combination thereof, as examples. Needs and potential for benefit or improvement also exist for heat pumps and methods of defrosting heat exchangers that that are inexpensive, that can be readily manufactured, that are easy to install, that are reliable, that have a long life, that are compact, that are efficient, that can withstand extreme environmental conditions, or a combination thereof, as examples.

Further, needs or potential for benefit or improvement exist for methods of controlling, manufacturing, and distributing such heat pumps, HVAC units, buildings, systems, devices, and apparatuses. Other needs or potential for benefit or improvement may also be described herein or known in the HVAC or heat pump industries. Room for improvement exists over the prior art in these and other areas that may be apparent to a person of ordinary skill in the art having studied this document.

SUMMARY OF PARTICULAR EMBODIMENTS OF THE INVENTION

This invention provides, among other things, heat pumps with improved defrost cycles, methods of defrosting heat exchangers, and methods of improving the effectiveness of defrost cycles of heat pumps. Various embodiments include a defrost valve located in a refrigerant conduit that opens during a defrost cycle to deliver hot refrigerant gas to a portion of the heat exchanger that otherwise defrosts more slowly or less completely than other portions of the heat exchanger. Particular embodiments pass hot refrigerant gas through a header of the heat exchanger without passing that same hot refrigerant gas through any of the cross tubes of the heat exchanger. In a number of embodiments, the defrost valve is open only during a portion of the defrost cycle. Further, in some embodiments, the fan that is used to blow air through the heat exchanger is operated in a reversed direction during the defrost cycle to counteract natural convection through the heat exchanger.

Various embodiments provide, for example, as an object or benefit, that they partially or fully address or satisfy one or more of the needs, potential areas for benefit, or opportunities for improvement described herein, or known in the art, as examples. Certain embodiments provide, for instance, heat pumps having improved defrost cycles, and methods of defrosting heat exchangers, that are more effective, that direct hot refrigerant gas to areas of the heat exchanger that otherwise would not get warm enough, that take less time to complete, that work satisfactorily with microchannel heat exchangers, or a combination thereof, as examples. In addition, a number of embodiments provide defrost cycles for heat pumps, and methods of defrosting heat exchangers, that reduce the amount of heat loss to the air from the heat exchanger during the defrost cycle, that reduce natural convection during the defrost cycle, or a combination thereof, as examples. Various embodiments are reasonably inexpensive, can be readily manufactured, are easy to install, are reliable, have a long life, are compact, are efficient, can withstand extreme environmental conditions, or a combination thereof, as examples.

Specific embodiments of the invention provide various heat pumps having improved defrost cycles. In a number of embodiments, for example, the heat pump can include, for example, a compressor, at least one expansion device, and a first heat exchanger. Further, in various embodiments, the first heat exchanger can include, for instance, a first header, a second header, and multiple cross tubes extending from the first header to the second header. Further still, in particular embodiments, each of the multiple cross tubes connects to the first header, each of the multiple cross tubes connects to the second header, the first header is parallel to the second header, and the multiple cross tubes are parallel to each other. Even further, in a number of embodiments, the multiple cross tubes each include multiple contiguous parallel refrigerant passageways therethrough. Even further still, various embodiments of such a first heat exchanger include multiple fins between the cross tubes that are bonded to the cross tubes.

Moreover, certain of these embodiments include at least one first connection point to the first heat exchanger where refrigerant is delivered to the first heat exchanger from the compressor during the defrost cycle, a second connection point to the first heat exchanger where refrigerant exits the first heat exchanger during the defrost cycle, and a third connection point to the first heat exchanger where refrigerant is also delivered from the compressor to the first heat exchanger during at least part of the defrost cycle. Further, a number of embodiments include a first refrigerant conduit connecting a discharge port on the compressor to the at least one first connection point of the first heat exchanger, a second refrigerant conduit connecting the second connection point of the first heat exchanger to the at least one expansion device, and a third refrigerant conduit connecting the first refrigerant conduit to the third connection point of the first heat exchanger. In various embodiments, a defrost valve is located in the third refrigerant conduit between the first refrigerant conduit and the third connection point of the first heat exchanger, and, when the defrost valve is closed, refrigerant flow through the third refrigerant conduit is blocked.

Furthermore, various such embodiments further include a control system that controls the defrost valve and opens the defrost valve during the defrost cycle allowing refrigerant to flow through the third refrigerant conduit to the third connection point to the first heat exchanger. Additionally, in a number of such embodiments, the first connection point to the first heat exchanger is at the first header, the second connection point to the first heat exchanger is at the second header, and the third connection point to the first heat exchanger is also at the second header. Even further, in various embodiments, refrigerant that, during at least part of the defrost cycle, passes through the third refrigerant conduit, through the defrost valve, and through the third connection point to the first heat exchanger, passes through the second header, heating the second header between the third connection point and the second connection point, without passing through any cross tubes of the first heat exchanger.

Further, in some such embodiments, the first heat exchanger includes a top and a bottom, the first header extends across the top of the first heat exchanger, and the second header extends across the bottom of the first heat exchanger. Further still, in certain embodiments, the first header is horizontal, the second header is horizontal, and each of the multiple cross tubes directly connects to the first header and directly connects to the second header. Even further, in particular embodiments, the first heat exchanger consists essentially of the first header, the second header, the multiple cross tubes, the multiple fins between the cross tubes (e.g., bonded to the cross tubes), the at least one first connection point to the first heat exchanger, the second connection point to the first heat exchanger, and the third connection point to the first heat exchanger. In particular embodiments, the first heat exchanger has only two headers, the first header and the second header.

Still further, certain embodiments can include, for example, an extension tube located within the second header, where the extension tube within the second header is substantially parallel to the second header, and the third connection point to the first heat exchanger is at the extension tube. Even further, in some embodiments, the second header has a first end and a second end, each of the multiple cross tubes connects to the second header between the first end and the second end, the second connection point to the first heat exchanger is at the second end of the second header, and the third connection point to the first heat exchanger is at the first end of the second header. Even further still, in particular embodiments, the first header has a third end and a fourth end, each of the multiple cross tubes connects to the first header between the third end and the fourth end, and the at least one first connection point to the first heat exchanger consists of a single first connection point at the third end of the first header. On the other hand, in other embodiments, the first header has a third end and a fourth end, and each of the multiple cross tubes connects to the first header between the third end and the fourth end, but the at least one first connection point to the first heat exchanger includes a primary first connection point to the heat exchanger at the third end of the first header and a secondary first connection point to the heat exchanger at the fourth end of the first header, and the first refrigerant conduit connects the discharge port on the compressor to the primary first connection point and to the secondary first connection point.

Additionally, in some embodiments, the control system includes a digital controller that can include, for example, programming instructions to open the defrost valve during the defrost cycle to defrost the first heat exchanger between the third connection point and the second connection point. In addition, in particular embodiments, the digital controller further includes programming instructions to keep the defrost valve closed when the heat pump is not in the defrost cycle. In certain embodiments, the digital controller further includes programming instructions to keep the defrost valve closed during part of the defrost cycle to defrost the first heat exchanger between the at least one first connection point and the second connection point.

What's more, in a number of embodiments, such a heat pump can include, for example, a first fan positioned and configured to move air through the first heat exchanger, and the control system can include a digital controller having, for instance, programming instructions to operate the first fan in a reversed direction during at least part of the defrost cycle to reduce natural convection through the first heat exchanger during the at least part of the defrost cycle. Further, in various embodiments, the heat pump can include a reversing valve located in the first refrigerant conduit between the discharge port on the compressor and the at least one first connection point of the first heat exchanger. In some embodiments, the third refrigerant conduit connects to the first refrigerant conduit between the reversing valve and the at least one first connection point of the first heat exchanger, for example. Further still, in some embodiments, the heat pump can include, as examples, a second heat exchanger, a fourth refrigerant conduit connecting the at least one expansion device to the second heat exchanger, a fifth refrigerant conduit connecting the second heat exchanger to the reversing valve, and a sixth refrigerant conduit connecting the reversing valve to an inlet port on the compressor.

Other specific embodiments of the invention provide various methods, for example, of defrosting a first heat exchanger of a heat pump. Such a heat pump can include, for example, the first heat exchanger, a compressor, at least one expansion device, and a second heat exchanger. Moreover, the first heat exchanger can include, for example, headers, multiple cross tubes, a first connection point to the first heat exchanger, a second connection point to the first heat exchanger, and a third connection point to the first heat exchanger. In a number of embodiments, such a method can include (e.g., in any order except where a particular order is explicitly indicated), at least certain acts. Such acts may include, for example, an act of operating the heat pump in a defrost mode during a defrost cycle, for instance, including delivering refrigerant from the compressor to the first connection point (i.e., of the first heat exchanger). Such a method can also include, in various embodiments, acts of, (e.g., during the defrost cycle), passing the refrigerant through the first heat exchanger from the first connection point (i.e., to the first heat exchanger), through the multiple cross tubes, to the second connection point (e.g., of the first heat exchanger), and (e.g., also during the defrost cycle) passing the refrigerant from the second connection point (i.e., of the first heat exchanger), through the at least one expansion device, and then to the second heat exchanger. Such a method can also include, in a number of embodiments, acts of, (e.g., during the defrost cycle), passing the refrigerant through the second heat exchanger, and then back to the compressor, and (e.g., during at least part of the defrost cycle) delivering at least part of the refrigerant from the compressor to the third connection point (i.e., of the first heat exchanger). Further, such a method can also include, in various embodiments, an act of, (e.g., during the defrost cycle), passing the at least part of the refrigerant from the third connection point (i.e., of the first heat exchanger), through one of the headers, to the second connection point (i.e., of the first heat exchanger), without passing the at least part of the refrigerant through any of the cross tubes of the first heat exchanger.

Further, in some such embodiments, the one of the headers of the first heat exchanger includes a first end and a second end, each of the cross tubes connect to the one of the headers between the first end and the second end, and the second connection point of the first heat exchanger is at the second end of the one of the headers. Further still, in various embodiments, the third connection point of the first heat exchanger is at the first end of the one of the headers, and the act of passing the refrigerant from the third connection point (i.e., of the first heat exchanger), through the one of the headers, to the second connection point (i.e., of the first heat exchanger) includes passing the refrigerant from the first end, through the one of the headers, to the second end. Even further, in some such embodiments, each cross tube includes multiple contiguous parallel refrigerant passageways therethrough, the first heat exchanger further includes multiple fins between the cross tubes that are bonded to the cross tubes, and the act of passing the refrigerant through the first heat exchanger from the first connection point (i.e., of the first heat exchanger), through the multiple cross tubes, to the second connection point (i.e., of the first heat exchanger) includes heating the multiple fins between the cross tubes.

In a number of embodiments, the act of delivering refrigerant from the compressor to the third connection point (i.e., of the first heat exchanger) includes opening a solenoid valve in a bypass refrigerant line extending from a supply refrigerant line connected to the first connection point (i.e., of the first heat exchanger), the bypass refrigerant line extending to the third connection point (i.e., of the first heat exchanger). Moreover, in some embodiments, such a method includes, during a first portion of the defrost cycle, not passing refrigerant through the third connection point (i.e., of the first heat exchanger), and during a second portion of the defrost cycle, passing refrigerant through the third connection point. Furthermore, in certain embodiments, the headers consist of a first header and a second header, the first connection point (i.e., to the first heat exchanger) is at the first header, the second connection point (i.e., to the first heat exchanger) is at the second header, and the third connection point (i.e., to the first heat exchanger) is also at the second header. Further, in a number of such embodiments, the act of passing the at least part of the refrigerant from the third connection point (i.e., of the first heat exchanger), through one of the headers, to the second connection point (i.e., of the first heat exchanger) includes passing the at least part of the refrigerant through the second header without passing the at least part of the refrigerant through any of the cross tubes of the first heat exchanger.

In various embodiments, the first heat exchanger is an outdoor air heat exchanger, the second heat exchanger is an indoor air heat exchanger, the first heat exchanger includes a top and a bottom, the first header extends across the top of the first heat exchanger, and the second header extends across the bottom of the first heat exchanger. Further, in some embodiments, each cross tube of the first heat exchanger includes multiple contiguous parallel refrigerant passageways therethrough, each of the multiple cross tubes directly connects to the first header, and each of the multiple cross tubes directly connects to the second header. Even further, in some embodiments, the first heat exchanger further includes multiple fins between the cross tubes that are bonded to the cross tubes, and the act of passing the refrigerant through the first heat exchanger from the first connection point (i.e., of the first heat exchanger), through the multiple cross tubes, to the second connection point (i.e., of the first heat exchanger) includes heating the multiple fins between the cross tubes. Even further still, in some embodiments, the act of delivering refrigerant from the compressor to the third connection point (i.e., of the first heat exchanger) includes opening a solenoid valve in a bypass refrigerant line extending from a supply refrigerant line connected to the first connection point (i.e., of the first heat exchanger), the bypass refrigerant line extending to the third connection point (i.e., of the first heat exchanger).

In still other specific embodiments, the invention provides various heat pumps that can include, for example, a compressor, at least one expansion device, and a first heat exchanger having a top and a bottom. Such a heat exchanger can consist essentially of, for example, a first header extending across the top of the first heat exchanger, a second header extending across the bottom of the first heat exchanger, multiple cross tubes extending from the first header to the second header, multiple fins between the cross tubes that are bonded to the cross tubes, and three types of connection points. In a number of such embodiments, each of the multiple cross tubes is directly connected to the first header, each of the multiple cross tubes is directly connected to the second header, and the multiple cross tubes each include multiple contiguous parallel refrigerant passageways therethrough. Further, in various embodiments, the three types of connection points consist of at least one first connection point where refrigerant is delivered to the first heat exchanger from the compressor during the defrost cycle, a second connection point where refrigerant exits the first heat exchanger during the defrost cycle, and a third connection point where refrigerant is also delivered from the compressor to the first heat exchanger during at least part of the defrost cycle.

In a number of such embodiments, the heat pump further includes a first fan positioned and configured to move air through the first heat exchanger, a second heat exchanger, and a first refrigerant conduit connecting a discharge port on the compressor to the at least one first connection point of the first heat exchanger, where the first refrigerant conduit does not include any part of the first heat exchanger. Further, in various embodiments, such a heat pump further includes a reversing valve located in the first refrigerant conduit between the discharge port on the compressor and the at least one first connection point of the first heat exchanger, a second refrigerant conduit connecting the second connection point of the first heat exchanger to the at least one expansion device, where the second refrigerant conduit does not include any part of the first heat exchanger, and a third refrigerant conduit connecting the first refrigerant conduit to the third connection point of the first heat exchanger. Still further, a number of such embodiments include a defrost valve, for example, located in the third refrigerant conduit between the first refrigerant conduit and the third connection point of the first heat exchanger, where, when the defrost valve is closed, refrigerant flow through the third refrigerant conduit is blocked, and a fourth refrigerant conduit connecting the at least one expansion device to the second heat exchanger. Even further, various embodiments include a fifth refrigerant conduit connecting the second heat exchanger to the reversing valve, a sixth refrigerant conduit connecting the reversing valve to an inlet port on the compressor, and a control system that controls the defrost valve, for example, that opens the defrost valve during the defrost cycle allowing refrigerant to flow through the third refrigerant conduit to the third connection point.

In a number of such embodiments, the control system includes a digital controller, for example, having programming instructions to open the defrost valve during the defrost cycle to defrost the first heat exchanger between the third connection point and the second connection point, and having programming instructions to keep the defrost valve closed when the heat pump is not in the defrost cycle. Further, in various embodiments, the third refrigerant conduit connects to the first refrigerant conduit between the reversing valve and the at least one first connection point of the first heat exchanger, the first connection point is at the first header, the second connection point is at the second header, and the third connection point is also at the second header. Further still, in a number of such embodiments, refrigerant that, during at least part of the defrost cycle passes through the third refrigerant conduit, through the defrost valve, and through the third connection point, passes through the second header, heating the second header between the third connection point and the second connection point, without passing through any cross tubes of the first heat exchanger.

Moreover, in some such embodiments, the second header has a first end and a second end, each of the multiple cross tubes connects to the second header between the first end and the second end, the second connection point to the first heat exchanger is at the second end of the second header, and the third connection point to the first heat exchanger is at the first end of the second header. Further, in a number of embodiments, during the defrost cycle, when the defrost valve is open, a first quantity of refrigerant passes from the compressor, and the defrost valve, the third refrigerant conduit, or both, are sized so that less than half of the first quantity of refrigerant from the compressor passes through the third connection point, and more than half of the first quantity of refrigerant from the compressor passes through the (e.g., at least one) first connection point. Further, in some embodiments, a centerline of the third connection point is within 20 degrees from a centerline of the second header. Further still, in some embodiments, a centerline of the third connection point is within 20 degrees from a centerline of the cross tubes. In addition, various other embodiments of the invention are also described herein, and other benefits of certain embodiments may be apparent to a person of ordinary skill in the art.

Figure 1:
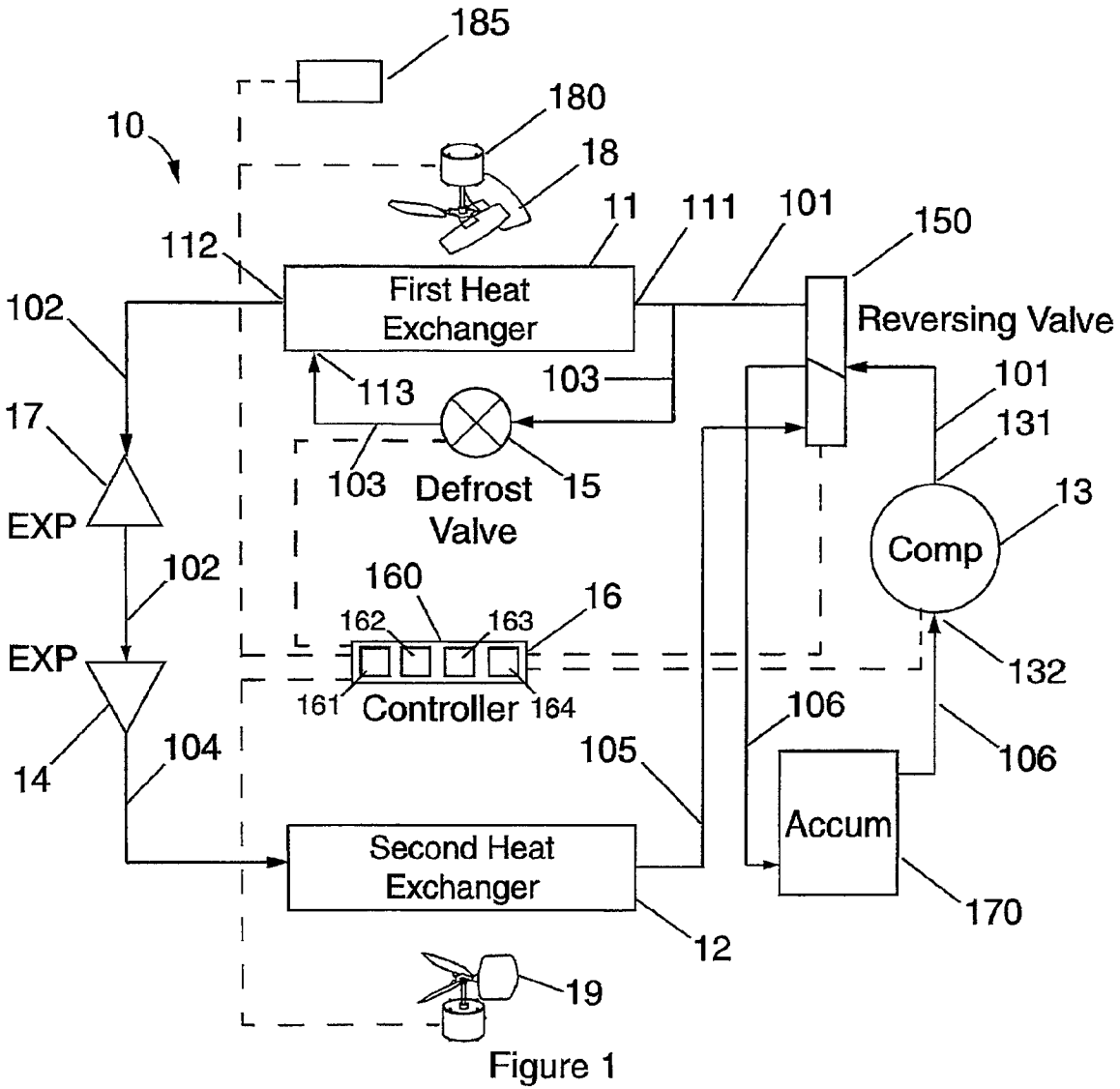
FIG. 1 is a block diagram illustrating an example of a heat pump having an improved defrost cycle.

These drawings illustrate, among other things, examples of certain aspects of particular embodiments of the invention. Other embodiments may differ. Various embodiments may include aspects shown in the drawings, described in the specification, shown or described in other documents that are incorporated by reference, known in the art, or a combination thereof, as examples.

DETAILED DESCRIPTION OF EXAMPLES OF EMBODIMENTS

A number of embodiments of the subject matter described herein include heat pumps, for example, with improved defrost cycles, methods of defrosting heat exchangers, and methods of defrosting heat exchangers and of improving the effectiveness of defrost cycles of heat pumps, as examples. These systems and methods may be used, for instance, with heat pumps having a microchannel (e.g., outdoor) heat exchanger. Various embodiments include a defrost valve located in a refrigerant conduit that opens during a defrost cycle to deliver hot refrigerant gas to a portion of the heat exchanger that otherwise defrosts more slowly or less completely than other portions of the heat exchanger. Particular embodiments pass hot refrigerant gas through a header of the heat exchanger (e.g., without that refrigerant passing through any cross tubes of that heat exchanger). Certain embodiments have two different connection points to the heat exchanger that are on the same header of the heat exchanger, one such connection point acting as an inlet to the heat exchanger and the other such connection point acting as an outlet from the heat exchanger. Further, in some embodiments, the fan that is used to blow air (e.g., outdoor air) through the heat exchanger is operated in a reversed direction during at least part of the defrost cycle to counteract natural convection through the heat exchanger.

In various embodiments, in a defrost mode, during a defrost cycle, refrigerant is delivered from the compressor to a first connection point of a first heat exchanger. The refrigerant is passed through the first heat exchanger from the first connection point (e.g., through multiple cross tubes) to a second connection point of the first heat exchanger. Further, also during the defrost cycle, the refrigerant is passed from the second connection point of the first heat exchanger, through at least one expansion device, and then to a second heat exchanger. Even further, the refrigerant is passed, in a number of embodiments, through the second heat exchanger, and then back to the compressor. Moreover, in certain embodiments, during at least part of the defrost cycle, refrigerant is delivered from the compressor to a third connection point of the first heat exchanger and is passed from the third connection point, through the second header, to the second connection point. Further, in various embodiments, the second connection point and the third connection point are both at the second header. Even further, in some embodiments, refrigerant that, during at least part of the defrost cycle, passes through the third refrigerant conduit, through the defrost valve, and through the third connection point, passes through the second header, heating the second header between the third connection point and the second connection point without passing through any cross tubes of the first heat exchanger. Further still, in a number of embodiments, the defrost valve is open only during a portion of the defrost cycle.

FIG. 1 illustrates an example of a heat pump having an improved defrost cycle. In this example, heat pump 10 includes first heat exchanger 11, compressor 13, expansion devices 14 and 17, first refrigerant conduit 101, second refrigerant conduit 102, third refrigerant conduit 103, defrost valve 15, and control system 16, for example, that controls defrost valve 15. Heat exchanger 11 can be a microchannel heat exchanger, for example, or in other embodiments, can be a different type of heat exchanger. In HVAC applications, for instance, heat exchanger 11 can be an outdoor heat exchanger. Further, in the embodiment shown, first heat exchanger 11 includes first connection point 111, second connection point 112, and third connection point 113.

As used herein, "connection points", are locations where a refrigerant conduit, such as refrigerant tubing, connects to the heat exchanger to deliver refrigerant to or from the heat exchanger. Connection points are openings on the heat exchanger before the heat exchanger is connected to the refrigerant conduits. A "refrigerant conduit", as used herein, is an enclosed passageway that refrigerant flows through during at least one mode of operation of the heat pump. As used herein, "refrigerant conduit" may include, as examples, tubing (e.g., copper), pipe, fittings, passageways through valve bodies, passageways through other components such as mufflers, dryers, accumulators, and compensators, as examples, or a combination thereof. As used herein, however, except where specifically stated otherwise, "refrigerant conduit" does not include any part of one or more headers or cross tubes of a heat exchanger (e.g., first heat exchanger 11 or second heat exchanger 12). In the HVAC context, as used herein, a "heat exchanger" (e.g., 11 or 12) is a component (e.g., of heat pump 10) that is used to heat or cool the refrigerant, and that, unless stated otherwise, is installed in the heat pump as a unit by connecting refrigerant conduits (e.g., 101, 102, and 103) at the connection points (e.g., 111, 112, and 113) of the heat exchanger. In a number of embodiments, the heat exchanger may also be (e.g., separately) structurally supported or attached when installed in the heat pump. In contrast, various refrigerant conduits (e.g., 101, 102, and 103) can be formed from separate components joined when the heat pump is assembled.

In the embodiment depicted, first refrigerant conduit 101 connects discharge port 131 on compressor 13 to first connection point 111 of first heat exchanger 11. As used herein, in this context, "connects" or "connecting" means provides, or providing an enclosed passageway therebetween for refrigerant to flow through, at least during one mode of operation of the heat pump. Further, as used herein, "directly connects" or "directly connecting" means provides, or providing an enclosed passageway therebetween for refrigerant to flow through, at least during one mode of operation of the heat pump, without another conduit or component therebetween. In the embodiment depicted, first refrigerant conduit 101 directly connects to discharge port 131 on compressor 13 and first refrigerant conduit 101 directly connects to first connection point 111 of first heat exchanger 11. Other embodiments, however, may differ.

Further still, in this embodiment, second refrigerant conduit 102 connects second connection point 112 of first heat exchanger 11 to expansion devices 14 and 17, and third refrigerant conduit 103 connects first refrigerant conduit 101 to third connection point 113 of first heat exchanger 11. Even further still, in this embodiment, second refrigerant conduit 102 directly connects to second connection point 112 of first heat exchanger 11 and second refrigerant conduit 102 directly connects to expansion devices 14 and 17. Similarly, third refrigerant conduit 103 directly connects to first refrigerant conduit 101 and third refrigerant conduit 103 directly connects to third connection point 113 of first heat exchanger 11. Other embodiments, however, may differ.

These "connection points" to the first heat exchanger, among other things, establish where the refrigerant is delivered to, and removed from, the heat exchanger, for example, during the defrost cycle. In particular embodiments, the refrigerant that is delivered from the compressor to the first heat exchanger through the third connection point exits the first heat exchanger through the second connection point. Further, in a number of embodiments, as described below with reference to other figures, both of these connection points are at the same header (e.g., the "second header"). As a result, in such embodiments, this portion of the refrigerant directly heats only the second header of the first heat exchanger.

Moreover, in this particular embodiment, defrost valve 15 is located in third refrigerant conduit 103, between first refrigerant conduit 101 and third connection point 113 of first heat exchanger 11. In this particular embodiment, when defrost valve 15 is closed, refrigerant flow through third refrigerant conduit 103 is blocked (i.e., completely blocked or substantially blocked to the extent that any leakage has a negligible impact on the performance of the heat pump) at defrost valve 15. Further, in the example of heat pump 10, control system 16 opens defrost valve 15 during the defrost cycle, for example, allowing refrigerant to flow through defrost valve 15 and third refrigerant conduit 103. In this operation, refrigerant flows to third connection point 113 to defrost first heat exchanger 11 between third connection point 113 and second connection point 112, for instance, during at least part of the defrost cycle.

Various embodiments have at least one expansion device, for instance, one or two expansion devices. In the embodiment shown, heat pump 10 has two expansion devices 14 and 17. In the embodiment illustrated, expansion device 14 is used when the refrigerant flows in one direction, and expansion device 17 is used when the refrigerant flows in the opposite direction. In this embodiment, expansion device 14 is used when heat pump 10 is operated in a cooling mode (i.e., cooling second heat exchanger 12) or in a defrost mode (i.e., defrosting first heat exchanger 11) and expansion device 17 is used when heat pump 10 is being operated in a heating mode (i.e., heating second heat exchanger 12). In this context, an expansion device being "used" means that the expansion device produces a substantial restriction to flow or pressure differential (i.e., across the expansion device). When an expansion device is not being used, in a number of embodiments, refrigerant passes through the expansion device or through a check valve arranged in parallel thereto, with little or no resistance to flow or pressure differential across the expansion device.

Although FIG. 1 is not drawn to scale, expansion device 17 would typically be close to first heat exchanger 11, and expansion device 14 would typically be close to second heat exchanger 12 (e.g., in a split HVAC system). Heat pumps that are used to provide heating only, and heat pumps that are used to provide cooling only, can have just one expansion device. Certain heat pumps that both heat and cool, however, may also have just one expansion device, in contrast with heat pump 10 illustrated (e.g., packaged units where one expansion device is adequate for flow in both directions in heating and cooling modes). Examples of expansion devices include orifices, orifice tubes, and various types of expansion valves. In different embodiments, expansion devices may control superheat (e.g., hold a constant superheat) in the heat exchanger acting as the evaporator. Examples include thermal expansion valves and electronic expansion valves.

Still referring to FIG. 1, in a number of embodiments, the portion of the heat exchanger (e.g., 11) that extends from the at least one first connection point (e.g., 111) to the second connection point (e.g., 112) includes at least half of the heat exchanger, for example, in terms of volume of the heat exchanger, surface area, or length of the flow passage through the heat exchanger. Further, in various embodiments, the portion of the heat exchanger (e.g., 11) that extends from the third connection point (e.g., 113) to the second connection point (e.g., 112) includes no more than half of the heat exchanger. Other embodiments, however, may differ.

Figure 2:
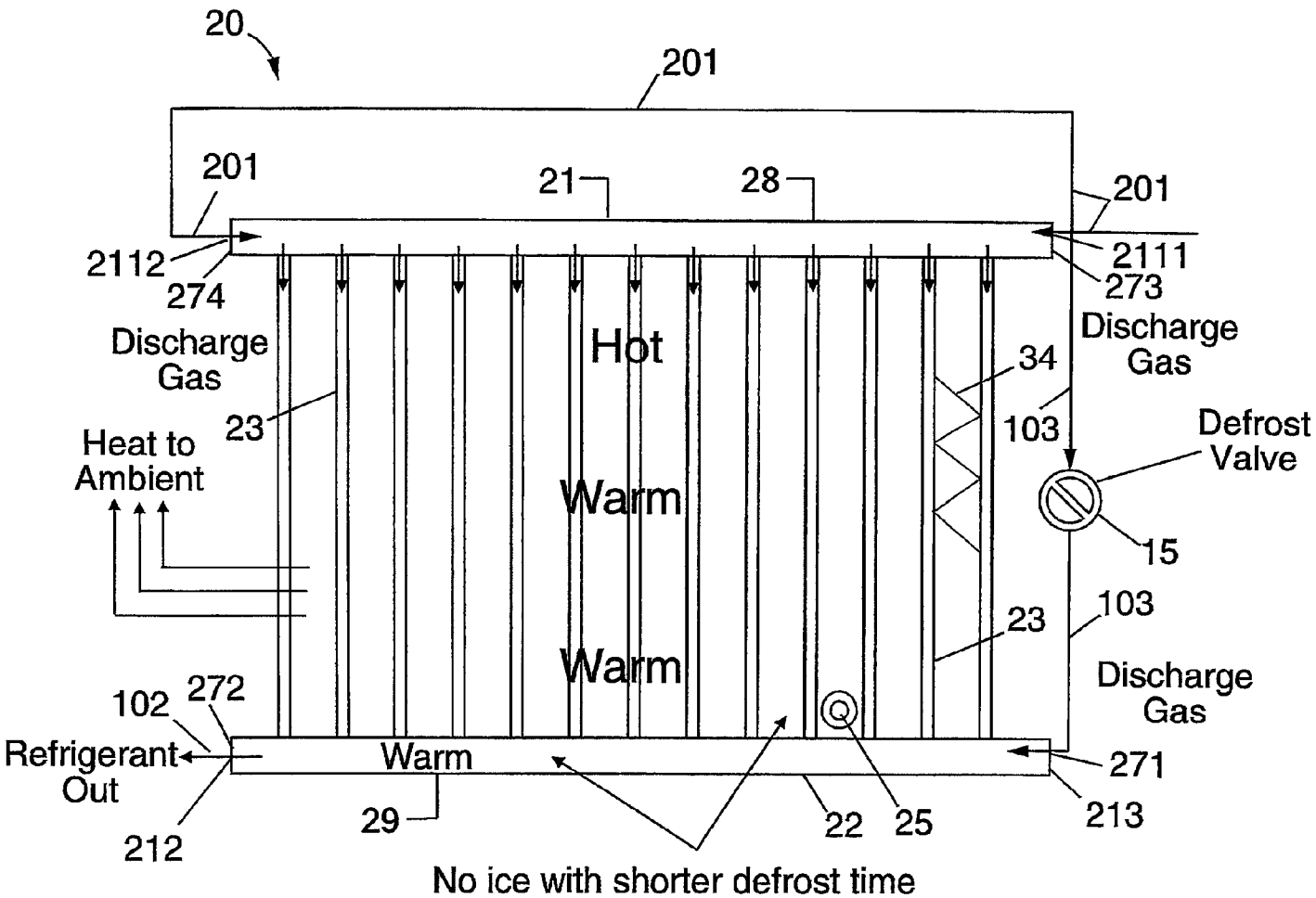
FIG. 2 is a front view of an example of a heat exchanger, for instance, of the heat pump illustrated in FIG. 1.

Turning now to the internal components of the heat exchanger, FIG. 2 illustrates first heat exchanger 20. In certain embodiments, heat exchanger 20 can be substituted for heat exchanger 11 of heat pump 10 shown in FIG. 1. Heat exchanger 20, however, has two first connection points 2111 and 2112, which correspond to first connection point 111 shown in FIG. 1. As illustrated, first heat exchanger 20 includes first header 21, second header 22, and multiple cross tubes 23 extending from first header 21 to second header 22. In this particular embodiment, each of multiple cross tubes 23 connects to first header 21 and each of multiple cross tubes 23 connects to second header 22. As used herein, in this context, "connects" means that a refrigerant passageway exists from the interior of the first header, through the (each) cross tube, to the interior of the second header.

In a number of embodiments, the first heat exchanger (e.g., 11 or 20) can be a standard or common design microchannel heat exchanger, for instance, without requiring expensive modifications such as special fins (e.g., slanted or extending beyond the cross tubes and connected to shed condensation) or an added intermediate (e.g., third) header and additional connections to cross tubes associated therewith. Further, in the particular embodiment shown, and in a number of embodiments, there are no feeder tubes between either header 21 or header 22 and any of cross tubes 23 and each of multiple cross tubes 23 directly connects to first header 21 and each of multiple cross tubes 23 directly connects to second header 22. As used herein, in this context, "directly connects" means "connects" without another conduit or component therebetween (e.g., each of multiple cross tubes 23 connects to first header 21 without another conduit or component, such as one or more feeder tubes, between any of cross tubes 23 and first header 21, and each of multiple cross tubes 23 connects to second header 22 without another conduit or component, such as one or more feeder tubes, between any of cross tubes 23 and second header 22).

Even further, as used herein, a "cross tube" in a heat exchanger is one of multiple tubes connected in parallel that extend from one header of the heat exchanger to another header of the heat exchanger (i.e., each cross tube is connected to the one header and to the other header). Further still, in a number of embodiments, including the embodiment shown in FIG. 2, each cross tube is directly connected to the one header and to the other header. Even further still, in heat exchangers that have fins, the cross tubes typically contact (e.g., with an interference fit) or are bonded to the fins (or both contacted and bonded). In other documents, "cross tubes", as used herein, have also been called (e.g., collectively) "coil rows", "tube sheets", or "exchange banks", and (e.g., individually) "heat exchange tubes", "heat transfer tubes" or "hairpin tubes" (e.g., for cross tubes in tube and fin heat exchangers with 180 degree bends).

Moreover, as used herein, a "header" in a heat exchanger is an enclosed passageway that refrigerant flows through during at least one mode of operation of the heat pump that connects multiple cross tubes of the heat exchanger together. A header can distribute or deliver refrigerant to multiple cross tubes, can collect refrigerant from multiple cross tubes, or both, for example, in different modes of operation of the heat pump. For example, in heat exchanger 20 shown in FIG. 2, during a cooling mode (i.e., when hot refrigerant gas is being delivered to heat exchanger 20 to be cooled and condensed), header 21 distributes and delivers the hot refrigerant gas to the multiple cross tubes 23 shown, and header 22 collects that refrigerant (e.g., after being cooled and condensed) from the multiple cross tubes 23. As another example, in heat exchanger 20, during a heating mode (i.e., when cold liquid refrigerant is being delivered to heat exchanger 20 to be heated and evaporated), header 20 distributes and delivers the cold liquid refrigerant to the multiple cross tubes 23 shown, and header 21 collects that refrigerant (e.g., after being heated and evaporated) from the multiple cross tubes 23. In various heat exchanger configurations, some of the heat transfer (e.g., to or from the refrigerant) can occur at one or more headers, but most of the heat transfer through a heat exchanger (e.g., to or from the refrigerant) usually occurs at the cross tubes. Further, headers have also been referred to as "manifolds".

In a number of embodiments, headers can be made of tubing, for example, with multiple connections (e.g., direct connections or indirect connections with feeder tubes) to cross tubes spaced along the length of each header (e.g., as shown in FIG. 2). Further, in some embodiments, cross tubes can be made of tubing, for example, with connections to the headers (e.g., direct connections or indirect connections with feeder tubes) at the ends of the cross tubes. Even further, in some embodiments (e.g., microchannel heat exchangers), cross tubes can each include multiple contiguous (e.g., parallel) refrigerant passageways therethrough (e.g., extending from first header 21 to second header 22). Still further, in the embodiment shown, cross tubes 23 are straight, but in other embodiments, cross tubes can be curved, can include one or more bends (e.g., 180 degree bends), or both. Even further still, in the embodiment shown, headers 21 and 22 are straight, but in other embodiments, headers can be curved, can include one or more bends (e.g., 90 degree bends), or both, as examples.

Moreover, in the embodiment shown in FIG. 2, first header 21 is parallel to second header 22, and multiple cross tubes 23 are parallel to each other and perpendicular to first header 21 and to second header 22. As used herein, "parallel", in this context means parallel to within 5 degrees, and "perpendicular", in this context, means perpendicular to within 5 degrees. Further, as used herein, "substantially parallel", means parallel to within 10 degrees, and "substantially perpendicular", means perpendicular to within 10 degrees. Even further, as used herein, "parallel", in this context means physically parallel, and these definitions refer to situations where components are physically parallel, as opposed to being "arranged" or "connected" in parallel. As used herein, components being "arranged" or "connected" in parallel means that the fluid (e.g., refrigerant) delivered to these components is divided between them as opposed to going through one component and then through the other component (e.g., as opposed to being connected or arranged in series). In other words, as used herein, components being "arranged" or "connected" in parallel means that the components are connected to form a parallel circuit. In the embodiment shown in FIG. 2, first header 21 is physically parallel to second header 22, and multiple cross 23 tubes are both physically parallel to each other and are connected in parallel (e.g., connected to headers 21 and 22). Further, in the embodiment shown, first header 21 is substantially parallel to second header 22, multiple cross 23 tubes are substantially parallel to each other, multiple cross tubes 23 are substantially perpendicular to first header 21, and multiple cross 23 tubes are substantially perpendicular to second header 22. Other embodiments can have a subcombination of these features, as other examples.

Figure 3:
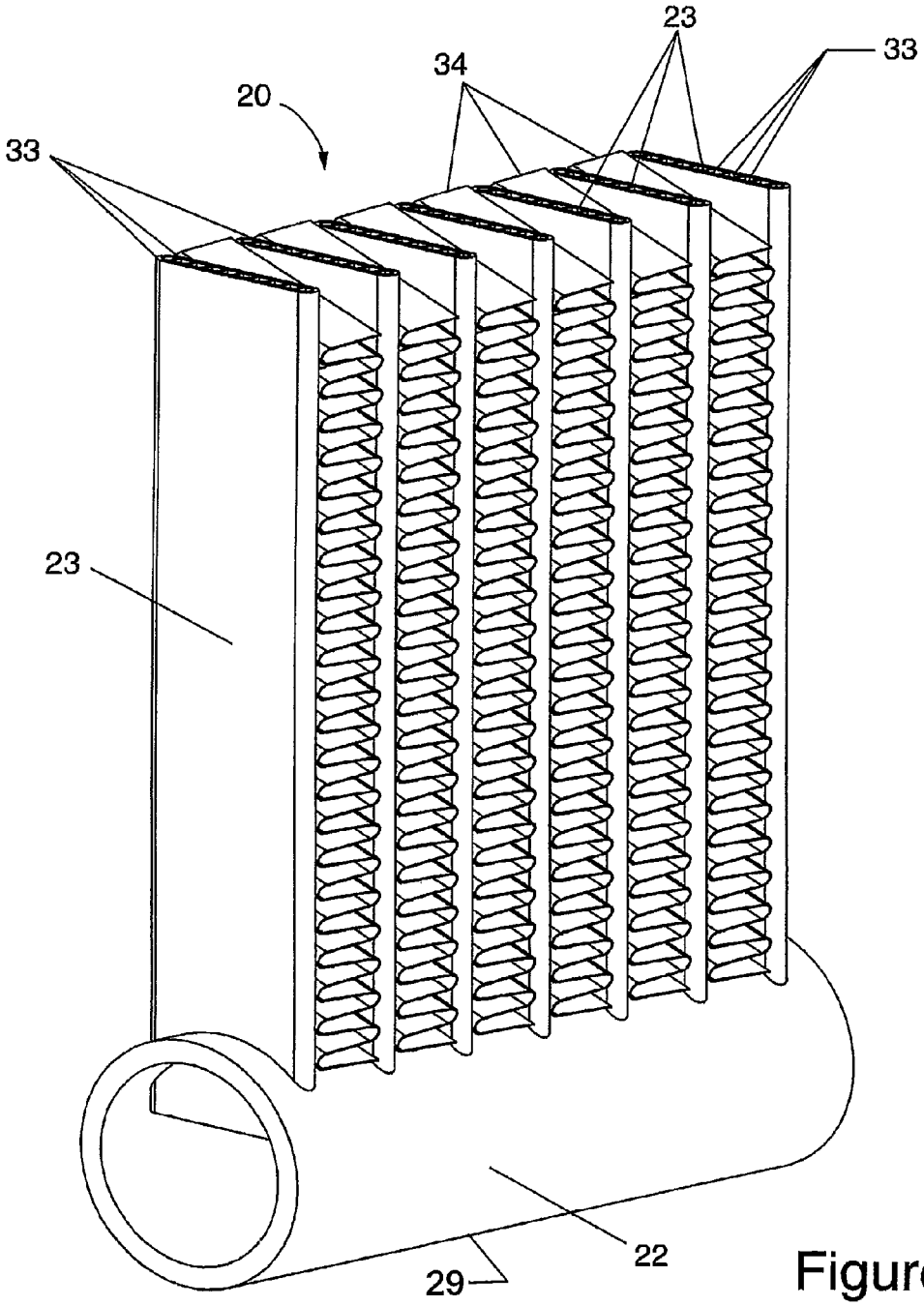
FIG. 3 is an isometric view showing part of a heat exchanger, such as the heat exchanger shown in FIG. 2.

FIG. 3 is a detailed view showing part of heat exchanger 20. As can bee seen in FIG. 3, multiple cross tubes 23 each include multiple contiguous parallel refrigerant passageways 33 therethrough (i.e., extending from first header 21 to second header 22 shown in FIG. 2). In this particular embodiment, passageways 33 are physically parallel as well as being connected in parallel. As used herein, however, "multiple contiguous parallel refrigerant passageways" means that the refrigerant passageways are connected in parallel, unless specifically stated otherwise. Further, in the particular embodiment shown, passageways 33 are arranged in a straight row. In various embodiments, refrigerant passageways may be arranged in one row, in at least one row, or in two rows, as examples, and in different embodiments, such rows may be straight or curved, for instance. Although not visible from the angle of FIG. 3, passageways 33 are open into second header 22 at the bottoms of cross tubes 23. Further, cross tubes 23 are sealed against slots in second header 22 where cross tubes 23 pass through the wall of second header 22 to prevent refrigerant from leaking out to the atmosphere. Further still, in this embodiment, first heat exchanger 20 further includes multiple fins 34 between cross tubes 23. The fins 34 can be bonded to the cross tubes 23, for example, by brazing. In a number of embodiments, brazing can also seal cross tubes 23 to second header 22 (and similarly to first header 21 shown in FIG. 2). In the embodiment illustrated, fins 34 are slanted, which may help to shed condensation, reduce airflow resistance through the heat pump, improve heat transfer, or a combination thereof, as examples. See U.S. patent application Ser. No. 12/561,178, Publication 2010/0071868, for example. In other embodiments, however, the fins may be square (e.g., horizontal or perpendicular to headers 21 and 22 and perpendicular to cross tubes 23 or passageways 33) rather than being slanted. Although not shown in FIG. 3, in certain embodiments, fins may include enhancements, such as louvers, which may improve heat transfer characteristics. Again, see U.S. patent application Ser. No. 12/561,178, Publication 2010/0071868, for example.

Figure 4:
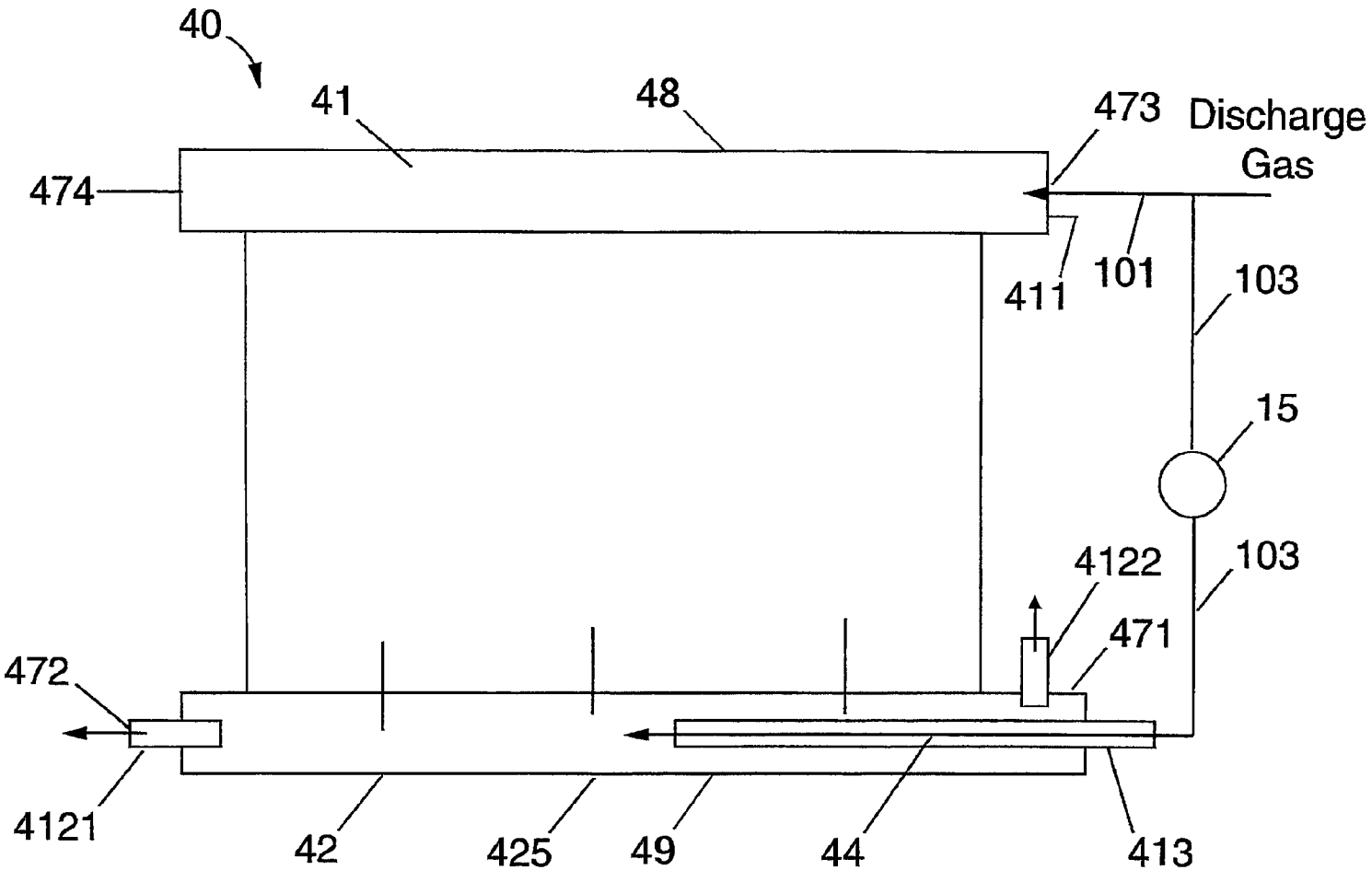
FIG. 4 is a front view of another example of a heat exchanger, for instance, of the heat pump illustrated in FIG. 1, this example having an extension tube.

FIG. 4 illustrates that in particular embodiments, the heat pump (e.g., 10 shown in FIG. 1) can further include extension tube 44, for instance, located within second header 42. Heat Exchanger 40 may be similar to heat exchanger 20 shown in FIG. 2, or to heat exchanger 11 shown in FIG. 1, except for extension tube 44, and that heat exchanger 40 discharges from second header 42 at both ends 472 and 471 (i.e., at second connection points 4121 and 4122 respectively) rather than at just one end (e.g., end 272 for heat exchanger 20 shown in FIG. 2). Although not shown, heat exchanger 44 can have cross tubes extending from header 41 to header 42, for instance, similar to cross tubes 23 shown in FIG. 2, can have fins (e.g., similar to fins 34 shown in FIG. 3), or both. In certain embodiments, heat exchanger 40 can be substituted for heat exchanger 11 of heat pump 10 shown in FIG. 1. In this embodiment, extension tube 44 within second header 42 is substantially parallel to second header 42. As mentioned, as used herein, "substantially parallel" means parallel to within 10 degrees. In particular embodiments, extension tube 44 may be parallel or concentric with second header 42, for example, or both.

Extension tube 44, in the embodiment shown in FIG. 4, in a defrost cycle, discharges hot refrigerant from the compressor (e.g., 13) substantially at midpoint 425 of second header 42. As used herein, "substantially at", in this context, means within 20 percent of the length of the header (e.g., second header 42) from the exact point (e.g., midpoint) of the header (e.g., 42). Further, as used herein, "at" a midpoint, in this context, means within 10 percent of the length of the header (e.g., second header 42) from the exact midpoint of the header (e.g., header 42). In some embodiments, extension tube 44 discharges hot refrigerant from the compressor (e.g., 13) at midpoint 425 of second header 42. The hot refrigerant then travels from midpoint 425 (e.g., approximately) to second connection points 4121 and 4122 heating and defrosting second header 42 and the portion of heat exchanger 40 near second header 42. In this embodiment, the at least one first connection point 411 (e.g., corresponding to first connection point 111 in FIG. 1) to first heat exchanger 40 (e.g., corresponding to heat exchanger 11 in FIG. 1) is at first header 41, the second connection points 4121 and 4122 (e.g., corresponding to second connection point 112 in FIG. 1) to first heat exchanger 40 are at second header 42, and the third connection point 413 (e.g., corresponding to third connection point 113 in FIG. 1) to the first heat exchanger 40 is at extension tube 44. As used herein, a connection point (e.g., 113 or 413) being "to" or "at" a header (e.g., 42) includes configurations having an extension tube (e.g., 44) located within the header (e.g., 42) where the connection point (e.g., 413) is to or at the extension tube (e.g., 44). Other embodiments may deliver hot refrigerant to the midpoint of the (e.g., second) header in a manner other than through extension tube 44, for example, through a tee or other fitting or connection in the (e.g., second) header (e.g., at or substantially at midpoint 425), as other examples.

In various embodiments, the third connection point (e.g., 113, 213, or 413) to the heat exchanger (e.g., first heat exchanger 11, 20, or 40) is parallel to, or concentric with, the second header (e.g., 22 or 42). Heat exchangers 20 and 40 are examples of such a configuration. In other embodiments, the third connection point can be at or within a specific angle from the header (e.g., second header 22 or 42) or cross tubes (e.g., 23), as other examples. In certain embodiments, a centerline of the third connection point can be at or within a specific angle from a centerline of the header (e.g., second header 22 or 42) or a centerline of the cross tubes (e.g., 23), as other examples. In different embodiments, such a specific angle can be, for example, 5, 10, 15, 20, 25, 30, 35, 40, 45, 50, 55, or 60 degrees. In particular embodiments, the third connection point can be at or within 20 degrees from the header (e.g., second header 22 or 42, for instance, when viewed from the perspective of FIGS. 2 and 4 or when viewed from the top or bottom) or cross tubes (e.g., 23, for example, when viewed from an end of the second header, looking through the second header), for instance. In certain embodiments, a centerline of the third connection point can be at or within 20 degrees from a centerline of the header (e.g., second header 22 or 42) or a centerline of the cross tubes (e.g., 23), as another example.

Some embodiments include a distributor tube in the second header (e.g., second header 22 shown in FIG. 2). The distributor tube (not shown) may connect to second end 272 of header 22, for example, and connection point 212 may be to or at the distributor tube such that refrigerant conduit 102 (e.g., shown in FIG. 1) connects or directly connects to the distributor tube. The distributor tube may extend into second header 22 over a majority of the length of header 22, for example, and may include holes therethrough. The distributor tube may distribute refrigerant more evenly to the heat exchanger, for example, when the heat pump is being operated in a heating mode. As used herein, a connection point being "to" or "at" a header includes configurations having a distributor tube located within the header where the connection point is at the distributor tube. The distributor tube does not necessarily provide any benefit during the cooling mode or the defrost cycle, but various embodiments of defrost cycle improvements may work satisfactorily with a distributor tube. Other embodiments, however, may lack a distributor tube (e.g., as shown in FIG. 2).

As mentioned, in the embodiment illustrated in FIG. 1, heat pump 10 has just one first connection point 111. Various embodiments include at least one first connection point. Particular embodiments include a heat pump (e.g., 10) with one connection point (e.g., 111 shown in FIG. 1) or with two connection points (e.g., 2111 and 2112 shown in FIG. 2), as examples. FIG. 4 also illustrates an embodiment with one first connection point (e.g., 411). Other embodiments may have 3, 4, 5, 6, or another number of first connection points, as other examples. Further, various embodiments may have 1, 2, 3, 4, 5, 6, or another number of second connection points (e.g., 112, 212, or 4121 and 4122), as further examples. Further still, other embodiments may have 1, 2, 3, 4, 5, 6, or another number of third connection points (e.g., 113, 213, or 413), as further examples.

In a number of embodiments, the at least one first connection point (e.g., 111 shown in FIG. 1, 2111 and 2112 shown in FIG. 2, or 411 shown in FIG. 4) to the first heat exchanger (e.g., 11 shown in FIG. 1, 20 shown in FIG. 2, or 40 shown in FIG. 4) is at the first header (e.g., 21 shown in FIG. 2 or 41 shown in FIG. 4). As used herein, a connection point being "at" or "to" a particular component (e.g., a particular header) means that the connection point is connected to the component such that refrigerant that passes through the connection point goes into or out of the component. In some embodiments, including the embodiments shown, the connection point is directly connected to the component. In other embodiments, however, the connection point can be connected to the component with another conduit or component (or components) therebetween (e.g., a fitting or part of a fitting, such as a tee, or an elbow, a section of tubing, multiple fittings, or a combination thereof). But as used herein, a connection point is not considered to be "at" or "to" a particular component (e.g., a particular header) if the connection point is only connected to the component through one or more cross tubes of a (any) heat exchanger. Further, in various embodiments, the "another conduit or component" connecting the connection point to the header is shorter (e.g., along a centerline) than the header, for example, shorter than ½, ⅓, ¼, ⅕, ⅙, ⅛, or 1/10 of the length of the header, as examples.

Further, in various embodiments, the second connection point (e.g., 112 shown in FIG. 1, 212 shown in FIG. 2, or 4121 and 4122 shown in FIG. 4) to the first heat exchanger (e.g., 11, 20, or 40) is at the second header (e.g., 22 or 42). Even further, in a number of embodiments, the third connection point (e.g., 113 shown in FIG. 1, 213 shown in FIG. 2, or 413 shown in FIG. 4) to the first heat exchanger (e.g., 11, 20, or 40) is at the second header (e.g., 22 or 42). In the traditional use of a heat exchanger such as first heat exchanger 20 shown in FIG. 2, if either or both of first connection point 2111 and 2112 is used as an inlet, and second connection point 212 is used as an outlet, then third connection point 213 would typically be used as an outlet, if used at all. (For example, some prior art uses of a heat exchanger similar to first heat exchanger 20 use first connection point 2111 as an inlet and second connection point 213 as an outlet and cap connection points 2112 and 213, or vice versa.) Thus, in a number of embodiments described herein, a connection point to a heat exchanger (i.e., third connection point 213 of first heat exchanger 20) that was used as an outlet in traditional use is being used as an inlet. This goes against conventional wisdom for heat exchanger design and use, but is a characteristic of a number of embodiments described herein.

Moreover, in the embodiments illustrated in FIGS. 2 and 4, the second header (e.g., 22 or 42) has a first end (e.g., 271 or 471) and a second end (e.g., 272 or 472). As used herein, an "end" of a header means the point on the header where the centerline of the header reaches the extreme edge or physical limit of the header. In this context, the "centerline" of the header is the longest major dimension of the header or a line (e.g., straight or curved) about which a majority of the header is concentric or symmetrical. Headers typically have two opposite "ends". As shown in FIG. 2, in this embodiment, each of the multiple cross tubes 23 connect to the second header 22 between the first end 271 and the second end 272. As used herein, cross tubes are only considered to be "cross tubes" if they are connected to carry refrigerant therethrough. Some embodiments of heat exchangers may have the physical structure of a cross tube (e.g., bonded to the fins) that is not connected (e.g., to headers 21 and 22) to carry refrigerant. Such a physical structure, not connected to carry refrigerant, is not considered to be a "cross tube" as used herein.

In the embodiment shown in FIG. 2, second connection point 212 to first heat exchanger 20 is at second end 272 of second header 22. As used herein, a connection point being "at" an end of a header means that the connection point is located within 1/10 of the length of the header, measured along the centerline of the header, from that end of the header. In some embodiments, however, a connection point can be at the very end of a header, or within 1/100, 1/50, 1/30, 1/25, 1/20, 1/15, 1/12, ⅛, ⅙, ⅕, ¼, or ⅓ of the length of the header, measured along the centerline of the header, from that end of the header, as other examples. For instance, in the embodiment shown, second connection point 212 to first heat exchanger 20 is at the very end of second header 22 at second end 272. In addition, in the embodiment shown, third connection point 213 to first heat exchanger 20 is at first end 271 of second header 22 (i.e., at the very end of header 22 at first end 271). Moreover, heat exchanger 20 can be substituted for first heat exchanger 11 in FIG. 1. In a number of such embodiments, when defrost valve 15 is open during a defrost cycle, hot refrigerant gas flows through second header 22 defrosting heat exchanger 20 at and near second header 22.

Other embodiments can have connection points that are not at headers or that are at headers but are not at the ends of the headers. In some embodiments, for example, one or more connections may tee into the header at the midpoint (e.g., 425) or may be spaced along the header, as examples. In certain embodiments, one or more headers may extend all the way around the unit (e.g., at the top or at the bottom of the unit) and may lack an "end", but may include a tee or other fitting forming a connection point to the header at one or more locations around the unit. Further, other embodiments of heat exchangers do not have a header or headers with cross tubes extending between the headers, but rather, have a continuous refrigerant pathway that may be larger in cross section than the passageways of the cross tubes described herein and longer, in order to provide the necessary or desired heat transfer performance.

Furthermore, in the embodiment shown in FIG. 2, first header 21 has third end 273 and fourth end 274. In this embodiment, each of the multiple cross tubes 23 connects to first header 21 between third end 273 and fourth end 274. In addition, in this particular embodiment, the at least one first connection point (e.g., corresponding to first connection point 111 shown in FIG. 1) to the first heat exchanger (e.g., 11 shown in FIG. 1 or 20 shown in FIG. 2) includes primary first connection point 2111 to heat exchanger 20 at third end 273 of first header 21 and secondary first connection point 2112 to heat exchanger 20 at fourth end 274 of first header 21. In certain embodiments, for instance, primary first connection point 2111 and secondary first connection point 2112 may be of equal size, identical but opposite hand, or both, as examples. In other embodiments, however, primary first connection point 2111 and secondary first connection point 2112 may differ in terms of size, configuration, or both.

Moreover, in the embodiment shown, if heat exchanger 20 is substituted for first heat exchanger 11 shown in FIG. 1, first refrigerant conduit 201 shown in FIG. 2, which is analogous to first refrigerant conduit 101 shown in FIG. 1, connects the discharge port (e.g., 131 shown in FIG. 1) on the compressor (e.g., 13 shown in FIG. 1) to primary first connection point 2111 and to secondary first connection point 2112. In other embodiments, the at least one first connection point (e.g., corresponding to 111 shown in FIG. 1) to the first heat exchanger (e.g., 11 shown in FIG. 1 or 21 shown in FIG. 2) consists of a single first connection point (e.g., 2111), for instance, at the third end (e.g., 273) of the first header (e.g., 21), as another example. As used herein, a particular connection point "consisting of a single connection point" (or that "consists of a single connection point") means that the particular connection point includes only one connection point (i.e., rather than two or more connection points). FIG. 4 illustrates an example wherein the at least one first connection point (e.g., corresponding to 111 shown in FIG. 1) to the first heat exchanger (e.g., 40) consists of single first connection point 411 at third end 473 of first header 41 (i.e., at the very end of header 41). In this particular embodiment of heat exchanger 40, fourth end 474 (opposite third end 473) may be plugged or capped, for example, and may not be used (i.e., as a connection point) in this particular embodiment.

Further, in yet another embodiment, the first refrigerant conduit (e.g., 101 shown in FIG. 1) can connect the discharge port (e.g., 131) on the compressor (e.g., 13 shown in FIG. 1) to the fourth end (e.g., 274 or 474) of the first heat exchanger (e.g., 20 or 40) and a further refrigerant conduit or portion of a refrigerant conduit, may connect the third end (e.g., 273 or 473) of the first header (e.g., 21 or 41) to the first end (e.g., 271 or 471) of the second header (e.g., 22 or 42). In this particular embodiment, the defrost valve (e.g., 15) can be located in this further refrigerant conduit or portion of a refrigerant conduit between the third end (e.g., 273 or 473) of the first header (e.g., 21 or 41) and the first end (e.g., 271 or 471) of the second header (e.g., 22 or 42). Referring to FIG. 1, in this embodiment, as used herein, the first header (21 or 41) can be considered part of the first refrigerant conduit (e.g., 101) or part of the third refrigerant conduit (e.g., 103).

In various embodiments, the control system (e.g., 16 shown in FIG. 1) includes a digital controller (e.g., 160) that includes programming instructions (e.g., 161) to open the defrost valve (e.g., 15), for instance, during the defrost cycle, to defrost the first heat exchanger (e.g., 11, 20, or 40), for example, between the third connection point (e.g., 113, 213, or 413) and the second connection point (e.g., 112, 212, or 4121 and 4122). Digital controller 160 may include, for instance, a microprocessor, memory, software, a display, a keyboard, a touch screen, electrical connectors, or a combination thereof, as examples. In some embodiments, digital controller 160 can be part of a defrost control board, for example, that may be located in an outdoor unit of a split HVAC system or in a packaged system, as examples. Digital controller 160 may open a valve, for example, (e.g., defrost valve 15) by sending a signal to the valve, by directing power to the valve, or by sending a signal to a relay to send power to the valve, as examples. Control system 16 or digital controller 160 may control various components of the heat pump (e.g., 10). Certain control pathways are illustrated with broken lines in FIG. 1. The illustrated control pathways, however, are not necessarily exhaustive. Other components of the heat pump may be controlled by control system 16 or digital controller 160 as well. Control pathways may include power wires, 24 V AC control wiring, digital signals, or a combination thereof, as examples. In some embodiments, control signals may be sent through wireless communications or via signals sent over power wires, as other examples. Control system 16 or digital controller 160 may turn various electrical components on and off, may control speeds of various motors (e.g., fan motors, the compressor motor, or a combination thereof), may control temperature (e.g., space temperature), may control defrost cycles, or a combination thereof, as examples.

Furthermore, in some embodiments, the digital controller (e.g., 160) further includes programming instructions (e.g., 162) to keep the defrost valve (e.g., 15) closed when the heat pump (e.g., 10) is not in the defrost cycle. "Keep(ing) the defrost valve closed", as used herein, means while the heat pump (e.g., compressor 13) is operating. When the heat pump is not operating (e.g., when compressor 13 is stopped or off), the defrost valve (e.g., 15) can be closed or open. In a number of embodiments, however, defrost valve 15 is normally closed, is closed when not powered, or is closed when the heat pump (e.g., compressor 13) is stopped or off, for instance. In addition, in some embodiments, the digital controller (e.g., 160) further includes programming instructions (e.g., 163) to keep the defrost valve (e.g., 15) closed during part of the defrost cycle, for example, to direct more (e.g., all when the defrost valve is closed) of the hot refrigerant through the at least one first connection point (e.g., 111, 2111 and 2112, or 411) to defrost, or to better defrost, the first heat exchanger (e.g., 11, 20, or 40) between the at least one first connection point (e.g., 111, 2111 and 2112, or 411) and the second connection point (e.g., 112, 212, or 4121 and 4122).

Furthermore, heat pump 10, in the embodiment shown in FIG. 1, further includes first fan 18 positioned and configured, for example, as shown, to move air (e.g., outdoor air or outside air) through first heat exchanger 11. In certain embodiments, the control system (e.g., 16) or digital controller (e.g., 160) includes programming instructions (e.g., 164) to operate the first fan (e.g., 18) in a reversed direction during at least part of the defrost cycle, for example, to reduce natural convection through the first heat exchanger (e.g., 11) during the at least part of the defrost cycle. As used herein, in this context, "reversed direction" means rotating in the opposite direction from fan operation in the heating or cooling mode. In various embodiments, the fan may be operated, in the defrost cycle or in part of the defrost cycle, in a direction that blows air downward, to counteract natural convection that tends to move the warm air upward. Reversed operation of the first fan or outdoor fan can benefit heat pumps with a microchannel heat exchanger (e.g., as shown in FIGS. 2 and 3), for example, but in different embodiments, can also benefit heat pumps with other types of heat exchangers.

In a number of embodiments, the first fan (e.g., 18) may be operated at a reduced or substantially reduced rate of speed (e.g., in the reversed direction) during the defrost cycle, in comparison with operation in the heating or cooling mode. As used herein, a "substantially reduced rate of speed" is less than or equal to 25 percent of the rated or maximum rate of speed. In particular embodiments, however, the "substantially reduced rate of speed" can be 25, 20, 15, 12, 10, 8, 7, 6, 5, 4, 3, 2, 1, or ½ percent of the rated or maximum rate of speed (e.g., of fan 18, fan motor 180, or a drive system therefor), as examples. Moreover, in certain embodiments, the "substantially reduced rate of speed" can be accomplished by intermittent operation (e.g., intermittent powering) or pulsing of the electrical power to the fan motor (e.g., 180). In particular embodiments, this intermittent operation or pulsing of the fan motor (e.g., 180) can be controlled by control system 16 or digital controller 160, for example, in the defrost board.

In a number of embodiments, motor 180 is a variable-speed motor and is capable of running in the reversed direction at a low speed. In various embodiments, a variable-speed drive unit may be included, such as a variable-frequency AC drive unit or a variable-voltage DC drive unit, as examples. In some embodiments, the minimum speed provided by the variable-speed drive unit may be sufficiently low with steady electrical power being provided to the motor (e.g., 180). In certain embodiments, however, the speed can be lowered further by providing power to the motor (e.g., 180) intermittently. In particular embodiments, this intermittent operation or pulsing of the fan motor (e.g., 180) can be controlled by control system 16 or digital controller 160, for example, by controlling the variable-speed drive unit.

Further, in some embodiments, the fan motor (e.g., 180) may be a single-speed motor or a two-speed motor, as examples, a variable-speed drive unit may not be provided, or a combination thereof, and the "substantially reduced rate of speed" may be accomplished by intermittent operation (e.g., intermittent powering) or pulsing of the electrical power to the fan motor (e.g., 180). In particular embodiments, this intermittent operation or pulsing of the fan motor (e.g., 180) can be controlled by control system 16 or digital controller 160, for example, by actuating a relay that turns electrical power to the fan motor (e.g., 180) on and off. Further, reversed operation of the first fan or outdoor fan can be used in combination with a defrost valve, or on units that do not have a defrost valve.

As further illustrated in FIG. 1, in some embodiments, the heat pump (e.g., 10) further includes a reversing valve (e.g., 150) located, for example, in the first refrigerant conduit (e.g., 101) between the discharge port (e.g., 131) on the compressor (e.g., 13) and the at least one first connection point (e.g., 111) of the first heat exchanger (e.g., 11). The reversing valve (e.g., 150) can be used to switch the heat pump between heating and cooling modes or between heating and defrost modes, for example. In the particular embodiment shown, for instance, third refrigerant conduit 103 connects to first refrigerant conduit 101 between reversing valve 150 and (e.g., the at least one) first connection point 111 of first heat exchanger 11. Moreover, in the embodiment show, heat pump 10 further includes second heat exchanger 12, a fourth refrigerant conduit 104 connecting (e.g., the at least one) expansion device 14 to second heat exchanger 12. Moreover, heat pump 10 further includes fifth refrigerant conduit 105 connecting second heat exchanger 12 to reversing valve 150, and sixth refrigerant conduit 106 connecting reversing valve 150 to inlet port 132 on compressor 13. In this particular embodiment, accumulator 170 is provided in, or connected to, sixth refrigerant conduit 106. Reversing valve 150 can be controlled by control system 16 or digital controller 160, for example.

In the embodiment illustrated, defrost valve 15 is a separate valve. Defrost valve 15 can be a solenoid valve, for example, that is either fully open or fully closed. Defrost valve 15 can be electrically operated, pilot operated, or both, as examples. In some embodiments, a check valve can be provided in series with defrost valve 15 to allow flow only in one direction, while in other embodiments, defrost valve 15 can be kept closed when flow through defrost valve 15, in either direction, is undesirable. Further, in the embodiment illustrated, when defrost valve 15 is open, refrigerant from compressor 13 can flow through defrost valve 15 to third connection point 113, 213, or 413, and through first connection point 111, 2111 and 2112, or 411. In other embodiments, however, a three-way valve can be used, or two of the two-way valves can be used, so that when refrigerant from the compressor is directed to the third connection point, the refrigerant is prevented from also flowing to the first connection point.

Thus, in the embodiment illustrated, when defrost valve 15 is open, first header 21 or 41 and cross tubes 23 are not isolated from refrigerant flow (e.g., hot refrigerant gas from compressor 13) through first connection point 111, 2111, 2112, or 411). But in other embodiments (e.g., where a three-way defrost valve is used where third refrigerant conduit 103 tees into (or directly connects to) first refrigerant conduit 101 instead of defrost valve 15 shown), when the defrost valve is open (i.e., positioned to allow hot refrigerant gas to flow into third connection point 113, 213, or 413), first header 21 or 41 and cross tubes 23 are isolated from refrigerant flow (e.g., hot refrigerant gas from compressor 13) through first connection point 111, 2111, 2112, or 411). In such embodiments, however, when the defrost valve is open (i.e., allowing hot refrigerant gas to flow into third connection point 113, 213, or 413), as trapped refrigerant within first header 21 or 41 and cross tubes 23, cools and contracts (e.g., condenses), hot refrigerant gas can enter cross tubes 23 from second header 22 or 42, and can enter first header 21 or 41 from cross tubes 23.

In the embodiment shown, defrost valve 15, third refrigerant conduit 103, or both, can be sized to deliver an appropriate amount of hot refrigerant to third connection point 113, 213, or 413, for instance. Further, in some embodiments, defrost valve 15, third refrigerant conduit 103, or both, can be sized so that less than half of the refrigerant from compressor 13 passes through third connection point 113, 213, or 413, for instance, while more than half of the refrigerant from compressor 13 passes through first connection point 111, 411, or 2111 and 2112. Further still, in some embodiments, defrost valve 15, third refrigerant conduit 103, or both, can be sized so that about 10, 20, 30, 40, or 50 percent of the refrigerant from compressor 13 passes through third connection point 113, 213, or 413, for instance, while the remainder of the refrigerant from compressor 13 passes through first connection point 111, 411, or 2111 and 2112. In this context, "about" means within plus or minus five (5) percent of the quantity (i.e., mass flow rate) of the refrigerant that passes from the compressor (e.g., 13) during the defrost cycle when the defrost valve (e.g., 15) is open. On the other hand, in some embodiments, defrost valve 15, third refrigerant conduit 103, or both, can be sized so that about 60, 70, 80, or 90 percent of the refrigerant from compressor 13 passes through third connection point 113, 213, or 413, for instance, while the remainder of the refrigerant from compressor 13 passes through first connection point 111, 411, or 2111 and 2112. In other embodiments, defrost valve 15 can be of a type suitable to modulate and throttle refrigerant therethrough and can deliver a regulated or measured amount of refrigerant to third connection point 113, 213, or 413, as another example. In some embodiments, defrost valve 15 can be part of an integrated valve module that performs other functions as well, or can be part of another component. In particular embodiments, for example, the defrost valve can be part of the reversing valve (e.g., 150), for example.

In many of the embodiments described herein, during a defrost cycle, refrigerant is delivered to the (e.g., first) heat exchanger (e.g., 11) at two different connection points (e.g., 111 and 113 shown in FIG. 1) and is removed from the heat exchanger at one connection point (e.g., 112). Delivery of refrigerant to one of the two connection points (e.g., 113) is turned on and off, and is off in the typical heating or cooling modes (e.g., using defrost valve 15). In other embodiments, during a defrost cycle, refrigerant is delivered to the heat exchanger at one connection point and is removed from the heat exchanger at two different connection points. In still other embodiments, during a defrost cycle, refrigerant is delivered to the heat exchanger at three different connection points (e.g., 2111, 2112, and 213 shown in FIG. 2) and is removed from the heat exchanger at one connection point (e.g., 212). Delivery of refrigerant to one of the three connection points (e.g., 213) is turned on and off, and is off in the typical heating or cooling modes (e.g., using defrost valve 15). In further embodiments, during a defrost cycle, refrigerant is delivered to the heat exchanger at two different connection points (e.g., 411 and 413) and is removed from the heat exchanger at two different connection points (e.g., 4121 and 4122). Delivery of refrigerant to one of the two connection points (e.g., 413) is turned on and off, and is off in the typical heating or cooling modes (e.g., using defrost valve 15). In still other embodiments, refrigerant may be passed through a heat exchanger in the opposite direction (e.g., from the second connection point to the first connection point rather than from the first connection point to the second connection point), or first in one direction, and then in the opposite direction, to promote more-even defrosting of the heat exchanger, as another example (e.g., rather than employing the third connection point, or in addition thereto).

As shown in FIGS. 2 and 4, in a number of embodiments, the first header is at the top of the first heat exchanger and the second header is at the bottom of the first heat exchanger, and the cross tubes are vertical. As used herein, "top", "bottom", "vertical", "horizontal", and similar words indicating direction are referring to the normal orientation of the unit when it is installed. In the embodiment shown in FIG. 2, first header 21 is at top 28 of first heat exchanger 20 and second header 22 is at bottom 29 of first heat exchanger 20. Similarly, in the embodiment shown in FIG. 4, first header 41 is at top 48 of first heat exchanger 40 and second header 42 is at bottom 49 of first heat exchanger 40. In other embodiments, however, the headers may be in opposite locations, or may be on opposite sides with the cross tubes horizontal, as other examples.

Figure 5:
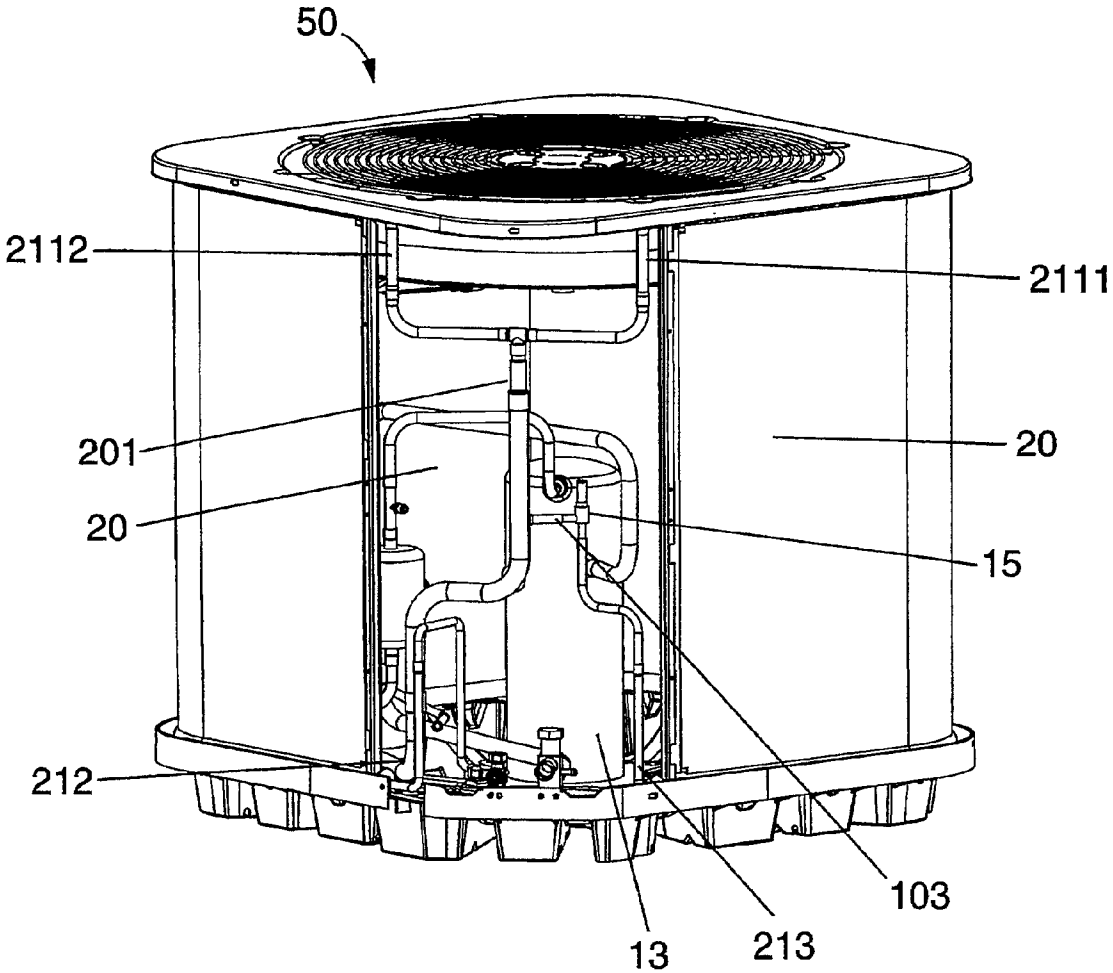
FIG. 5 is an isometric view of an outdoor HVAC unit for a split HVAC system.

FIG. 5 illustrates outdoor unit 50 for a split system HVAC system, with a corner access panel removed and a louvered cover removed from over the (first) heat exchanger. As used herein, an HVAC system is a system that provides air conditioning, heating, or both air conditioning and heating, as well as providing air movement (ventilation). Further, as used herein, an HVAC heat pump provides heating to the space (e.g., within the building), for example, using the compressor. Unit 50 includes a first heat exchanger, which may be similar to heat exchanger 20 shown in FIG. 2 and which is labeled as heat exchanger 20. Unit 50 also includes, in this particular embodiment, components of heat pump 10 shown in FIG. 1, except that second heat exchanger 12, second fan 19, expansion device 14, refrigerant conduit 104, and part of refrigerant conduits 102 and 105 are located in a separate indoor unit or air handler, which may also include an air filter, among other things. Control system 16, digital controller 160, or both, may be located in unit 50, in the indoor unit, elsewhere, or a combination thereof. Unit 50 also includes a compressor (e.g., 13 shown in FIGS. 1 and 5) and a first fan (e.g., 18, shown in FIG. 1 but not shown in FIG. 5). Unit 50 has two first connection points 2111 and 2112 to first heat exchanger 20, as shown in FIG. 2, rather than a single first connection point 111 shown in FIG. 1. Not shown in FIG. 2, the first heat exchanger 20 in unit 50 includes three 90-degree radiused bends, in this embodiment, and extends around unit 50 from first connection point 2111 to second connection point 2112. In other embodiments, heat pump 10, for example, may be a packaged HVAC unit, or may be another type of heat pump, as examples.

Referring to FIGS. 1-5, as mentioned, various embodiments are heat pumps (e.g., 10 or 50) having improved defrost cycles. In a number of embodiments, as described, the heat pump can include, for example, a compressor (e.g., 13), at least one expansion device (e.g., 14, 17, or both), and a first heat exchanger (e.g., 11, 20, or 40). Further, in various embodiments, the first heat exchanger can include, for instance, a first header (e.g., 21 or 41), a second header (e.g., 22 or 42), and multiple cross tubes (e.g., 23) extending from the first header to the second header. Further still, in particular embodiments, each of the multiple cross tubes connects to the first header, each of the multiple cross tubes connects to the second header, the first header is parallel to the second header, and the multiple cross tubes are parallel to each other. Even further, in a number of embodiments, the multiple cross tubes each include multiple contiguous parallel refrigerant passageways (e.g., 33 shown in FIG. 3) therethrough. Even further still, various embodiments of such a first heat exchanger include multiple fins (e.g., 34) between the cross tubes that are bonded to the cross tubes.

Moreover, certain of these embodiments include at least three connection points or types of connection points to the (e.g., first) heat exchanger where refrigerant is delivered to or removed from the heat exchanger. Examples of these connection points or types of connection points include (e.g., at least one) first connection point (e.g., 111, 2111 and 2112, or 411) to the first heat exchanger where refrigerant is delivered to the first heat exchanger from the compressor during the defrost cycle. Another example of these three (e.g., types of) connection points is a second connection point (e.g., 112, 212, 4121 and 4122) to the first heat exchanger where refrigerant exits the first heat exchanger during the defrost cycle. Still another example of these three (e.g., types of) connection points is a third connection point (e.g., 113, 213, or 413) to the first heat exchanger where refrigerant is delivered from the compressor to the first heat exchanger during at least part of the defrost cycle.

Further, a number of these embodiments include a first refrigerant conduit (e.g., 101) connecting a discharge port (e.g., 131) on the compressor (e.g., 13) to the at least one first connection point (e.g., 111, 2111 and 2112, or 411) of the first heat exchanger (e.g., 11, 20, or 40), a second refrigerant conduit (e.g., 102) connecting the second connection point (e.g., 112, 212, 4121 and 4122) of the first heat exchanger to the at least one expansion device (e.g., 14, 17, or both), and a third refrigerant conduit (e.g., 103) connecting the first refrigerant conduit to the third connection point (e.g., 113, 213, or 413) of the first heat exchanger. In various embodiments, a defrost valve (e.g., 15) is located in the third refrigerant conduit between the first refrigerant conduit and the third connection point of the first heat exchanger, and, when the defrost valve is closed, refrigerant flow through the third refrigerant conduit is blocked.

Furthermore, various such embodiments further include a control system (e.g., 16) that controls the defrost valve (e.g., 15) and opens the defrost valve during the defrost cycle allowing refrigerant to flow through the third refrigerant conduit to the third connection point to the first heat exchanger. Additionally, in a number of such embodiments, the first connection point to the first heat exchanger is at the first header (e.g., 21 or 41), the second connection point to the first heat exchanger is at the second header (e.g., 22 or 42), and the third connection point to the first heat exchanger is also at the second header. Thus, the second connection point and the third connection point are at the same header in such embodiments.

Various embodiments go against conventional wisdom by mixing hot refrigerant gas with cooler refrigerant liquid, for example, in the second header (e.g., 22 or 42), as well as by introducing the hot refrigerant gas (e.g., during the defrost cycle) at the same header where that refrigerant exits the heat exchanger (e.g., 11, 20, or 40). Although the different headers of heat exchangers are commonly used for different purposes depending on the cycle of the heat pump (e.g., heating mode v. defrost mode), in the prior art, the header of a heat exchanger is only used for one type of connection point (e.g., inlet or outlet) at a time, not both. As a result, it would not have been expected that locating an inlet connection point (e.g., the third connection point) and an outlet connection point (e.g., the second connection point) at the same header (e.g., the second header) would have produced an improved defrost cycle. In fact, such a modification would have been expected to decrease the effectiveness of the defrost cycle. Consequently, various embodiments of the present invention produce an unexpected result.

Even further, in various embodiments, refrigerant that, during at least part of the defrost cycle, passes through the third refrigerant conduit, through the defrost valve, and through the third connection point to the first heat exchanger (e.g., 11, 20, or 40), then passes through the second header (e.g., 22 or 42), heating the second header between the third connection point to the first heat exchanger and the second connection point to the first heat exchanger without passing through any cross tubes (e.g., 23) of the first heat exchanger. As used herein, refrigerant that passes through certain components of a heat exchanger "without passing through any cross tubes of the (e.g., first) heat exchanger" bypasses all of the cross tubes of the heat exchanger, whether such cross tubes are in the same row or different rows of the heat exchanger. As used herein, refrigerant passing through some of the cross tubes (e.g., whether or not cross tubes 23 shown) of a heat exchanger, but not through other cross tubes of that same heat exchanger (e.g., 23), is not sufficient to meet the condition of not passing through "any" cross tubes of the heat exchanger.

Further, in some such embodiments, the first heat exchanger includes a top (e.g., 28 or 48) and a bottom (e.g., 29 or 49), the first header (e.g., 21 or 41) extends across the top of the first heat exchanger, and the second header (e.g., 22 or 42) extends across the bottom of the first heat exchanger. Further still, in certain embodiments, the first header is horizontal and the second header is horizontal (e.g., as shown in FIGS. 2 and 4) and each of the multiple cross tubes directly connects to the first header and directly connects to the second header (e.g., as shown in FIG. 3 for cross tubes 23 and header 22). Various embodiments go against conventional wisdom by mixing hot refrigerant gas with cooler refrigerant liquid, for example, in the second header (e.g., 22 or 42). In these embodiments, hot refrigerant gas introduced, for instance, through the third connection point (e.g., 113, 213, or 413), is mixed in the second header with cooler refrigerant liquid that cooled after passing through the cross tubes (e.g., 23) from the first header (e.g., 21 or 41) after being introduced to the heat exchanger through the first connection point (e.g., 111, 2111, 2112, or 411).

In a number of embodiments, the second header (e.g., 22 or 42), which is heated during the defrost cycle, extends (e.g., horizontally) across the bottom (e.g., 29 or 49) of the (e.g., first) heat exchanger (e.g., 11, 20, or 40). This configuration differs from that of typical prior art heat pumps, for example, where the headers are at the side and the cross tubes are horizontal, or from most prior art uses of microchannel heat exchangers. The fact that the second header extends across the bottom of the heat exchanger, in some embodiments, can help to defrost the heat exchanger because air surrounding the header is heated and rises to heat the fins above. In addition, in a number of embodiments, the less-dense hot refrigerant gas entering the second header at the third connection point (e.g., 113, 213, or 413) stays at the top of the second header heating the bottom ends of the cross tubes (e.g., 23, as shown in FIG. 3) that penetrate the header, while the denser cold liquid refrigerant flowing into the second header through the cross tubes drops to the bottom of the second header. Prior art units which have the headers on the side, do not have this benefit. Natural convection around one or more of the headers of a prior art unit having the headers on the sides, would be expected to rise upward missing the cross tubes. In addition, separation of the liquid and gas refrigerant in the headers of such a prior art unit would be a disadvantage since warmer gas refrigerant would be delivered to the top part of the heat exchanger while colder liquid refrigerant, having a higher viscosity and without the availability of latent energy, would be delivered to the bottom part of the heat exchanger, leaving the bottom less well defrosted.

Even further, in particular embodiments, the first heat exchanger (e.g., 20) consists essentially of the first header (e.g., 21), the second header (e.g., 22), the multiple cross tubes (e.g., 23), the multiple fins (e.g., 34) between the cross tubes (e.g., bonded to the cross tubes), the at least one first connection point (e.g., 111, 2111 and 2112, or 411) to the first heat exchanger, the second connection point (e.g., 112, 212, or 4121 and 4122) to the first heat exchanger, and the third connection point (e.g., 113, 213, or 413) to the first heat exchanger. As used herein, saying that a component "consists essentially of" a list of parts, means the component includes only those parts on the list plus additional parts that do not materially affect the basic characteristics of the component. Further, as used herein, saying that a heat exchanger "consists essentially of" a list of parts means that the heat exchanger cannot include any additional headers, cross tubes, or feeder tubes (i.e., connecting the headers to the cross tubes) not specifically included in the list of parts. In particular embodiments, the first heat exchanger has only two headers, the first header and the second header for example.

Still further, certain of these embodiments can include, for example, an extension tube (e.g., 44 shown in FIG. 4) located within the second header (e.g., 42), where the extension tube within the second header is substantially parallel to the second header, and the third connection point (e.g., 413) to the first heat exchanger is at the extension tube. Even further, in some embodiments, the second header has a first end (e.g., 271 or 471) and a second end (e.g., 272 or 472), each of the multiple cross tubes connects to the second header between the first end and the second end, the second connection point to the first heat exchanger is at the second end of the second header, and the third connection point to the first heat exchanger is at the first end of the second header.

Even further still, in particular embodiments (e.g., shown in FIG. 2) the first header (e.g., 21) has a third end (e.g., 273) and a fourth end (e.g., 274), and each of the multiple cross tubes (e.g., 23) connects to the first header between the third end and the fourth end, and the at least one first connection point to the first heat exchanger includes a primary first connection point (e.g., 2111) to the heat exchanger at the third end (e.g., 273) of the first header and a secondary first connection point (e.g., 2112) to the heat exchanger at the fourth end (e.g., 274) of the first header. In this example, the first refrigerant conduit (e.g., 101 or 201) connects the discharge port (e.g., 131 shown in FIG. 1) on the compressor (e.g., 13) to the primary first connection point and to the secondary first connection point. On the other hand, in other embodiments (e.g., shown in FIG. 4), the first header (e.g., 41) has a third end (e.g., 473) and a fourth end (e.g., 474), each of the multiple cross tubes connects to the first header between the third end and the fourth end (e.g., as shown in FIG. 2 for cross tubes 23 and headers 21 and 22), and the at least one first connection point to the first heat exchanger consists of (i.e., only) a single first connection point (e.g., 411) at the third end of the first header.

Additionally, in some such embodiments, the control system (e.g., 16) includes a digital controller (e.g., 160 shown in FIG. 1) that can include, for example, programming instructions (e.g., 161) to open the defrost valve during the defrost cycle to defrost the first heat exchanger between the third connection point and the second connection point. In addition, in particular embodiments, the digital controller further includes programming instructions (e.g., 162) to keep the defrost valve closed when the heat pump is not in the defrost cycle. In certain embodiments, the digital controller further includes programming instructions (e.g., 163) to keep the defrost valve closed during part of the defrost cycle to defrost the first heat exchanger between the at least one first connection point and the second connection point.

What's more, in a number of embodiments, such a heat pump can include, for example, a first fan (e.g., 18 shown in FIG. 1) positioned and configured to move air through the first heat exchanger (e.g., 11, 20, or 40), and the control system (e.g., 16) can include a digital controller (e.g., 160) having, for instance, programming instructions (e.g., 164) to operate the first fan in a reversed direction during at least part of the defrost cycle to reduce natural convection through the first heat exchanger during the at least part of the defrost cycle. Further, in various embodiments, the heat pump can include a reversing valve (e.g., 150) located in the first refrigerant conduit (e.g., 101) between the discharge port (e.g., 131) on the compressor (e.g., 13) and the at least one first connection point (e.g., 111, 2111 and 2112, or 411) of the first heat exchanger. In some embodiments, the third refrigerant conduit (e.g., 103) connects to the first refrigerant conduit between the reversing valve and the at least one first connection point of the first heat exchanger, for example. Further still, in some embodiments, the heat pump can include, as examples, a second heat exchanger (e.g., 12), a fourth refrigerant conduit (e.g., 104) connecting the at least one expansion device to the second heat exchanger, a fifth refrigerant conduit (e.g., 105) connecting the second heat exchanger to the reversing valve, and a sixth refrigerant conduit (e.g., 106) connecting the reversing valve to an inlet port (e.g., 132) on the compressor.

Still other embodiments include heat pumps (e.g., 10 or 50) that include, for example, a compressor (e.g., 13), at least one expansion device (e.g., 14, 17, or both), and a first heat exchanger (e.g., 11, 20, or 40) having a top (e.g., 28 or 48) and a bottom (e.g., 29 or 49). Such a heat exchanger can consist essentially of, for example, a first header (e.g., 21 or 41) extending across the top (e.g., 28 or 48) of the first heat exchanger, a second header (e.g., 22 or 42) extending across the bottom (e.g., 29 or 49) of the first heat exchanger, and multiple cross tubes (e.g., 23) extending from the first header to the second header, multiple fins (e.g., 34) between the cross tubes that are bonded to the cross tubes, and three types of connection points. In a number of such embodiments, each of the multiple cross tubes is directly connected to the first header, each of the multiple cross tubes is directly connected to the second header (e.g., as shown in FIG. 3 for cross tubes 23 and header 22), and the multiple cross tubes each include multiple contiguous parallel refrigerant passageways (e.g., 33) therethrough. Further, in various embodiments, the three types of connection points consist of at least one first connection point (e.g., 111, 2111 and 2112, or 411) where refrigerant is delivered to the first heat exchanger from the compressor during the defrost cycle, a second connection point (e.g., 112, 212, or 4121 and 4122) where refrigerant exits the first heat exchanger during the defrost cycle, and a third connection point (e.g., 113, 213, or 413) where refrigerant is delivered from the compressor to the first heat exchanger during at least part of the defrost cycle.

In a number of such embodiments, the heat pump further includes a first fan (e.g., 18) positioned and configured to move air through the first heat exchanger, a second heat exchanger (e.g., 12), and a first refrigerant conduit (e.g., 101) connecting a discharge port (e.g., 131) on the compressor to the at least one first connection point of the first heat exchanger (e.g., where the first refrigerant conduit does not include any part of the first heat exchanger). Further, in various embodiments, such a heat pump further includes a reversing valve (e.g., 150) located in the first refrigerant conduit between the discharge port on the compressor and the at least one first connection point of the first heat exchanger, a second refrigerant conduit (e.g., 102) connecting the second connection point of the first heat exchanger to the at least one expansion device, wherein the second refrigerant conduit does not include any part of the first heat exchanger, and a third refrigerant conduit (e.g., 103) connecting the first refrigerant conduit to the third connection point of the first heat exchanger.

Still further, a number of such embodiments include a defrost valve (e.g., 15), for example, located in the third refrigerant conduit (e.g., 103) between the first refrigerant conduit (e.g., 101) and the third connection point (e.g., 113, 213, or 413) of the first heat exchanger (e.g., wherein, when the defrost valve is closed, refrigerant flow through the third refrigerant conduit is blocked), and a fourth refrigerant conduit (e.g., 104) connecting the at least one expansion device to the second heat exchanger (e.g., 12). Even further, various embodiments include a fifth refrigerant conduit (e.g., 105) connecting the second heat exchanger to the reversing valve, a sixth refrigerant conduit (e.g., 106) connecting the reversing valve to an inlet port (e.g., 132) on the compressor, and a control system (e.g., 16) that controls the defrost valve, for example, that opens the defrost valve during the defrost cycle allowing refrigerant to flow through the third refrigerant conduit to the third connection point.

In a number of such embodiments, the control system (e.g., 16) includes a digital controller (e.g., 160), for example, having programming instructions (e.g., 161) to open the defrost valve during the defrost cycle to defrost the first heat exchanger between the third connection point and the second connection point, and having programming instructions (e.g., 162) to keep the defrost valve closed when the heat pump is not in the defrost cycle. Further, in various embodiments, the third refrigerant conduit connects to the first refrigerant conduit between the reversing valve and the at least one first connection point of the first heat exchanger, the first connection point is at the first header, the second connection point is at the second header, and the third connection point is at the second header. Further still, in a number of such embodiments, refrigerant that, during at least part of the defrost cycle passes through the third refrigerant conduit, through the defrost valve, and through the third connection point, passes through the second header (e.g., 22 or 42), heating the second header between the third connection point and the second connection point without passing through any cross tubes (e.g., 23) of the first heat exchanger. Moreover, in some such embodiments, the second header (e.g., 22 or 42) has a first end (e.g., 271 or 471) and a second end (e.g., 272 or 472), each of the multiple cross tubes connects to the second header between the first end and the second end, the second connection point to the first heat exchanger is at the second end (e.g., 272 or 472) of the second header, and the third connection point to the first heat exchanger is at the first end (e.g., 271 or 471) of the second header.

In a number of embodiments, during the defrost cycle, when the defrost valve (e.g., 15) is open, a first quantity of refrigerant passes from the compressor (e.g., 13, for instance, through discharge port 131 and first refrigerant conduit 101), and the defrost valve (e.g., 15), the third refrigerant conduit (e.g., 103), or both, are sized so that less than half of the first quantity of refrigerant from the compressor passes through the third connection point (e.g., 113, 213, or 413), and more than half of the first quantity of refrigerant from the compressor passes through the (e.g., at least one) first connection point (e.g., 111, 2111 and 2112, or 411). Further, in some embodiments, a centerline of the third connection point (e.g., 113, 213, or 413) is within 20 degrees from a centerline of the second header (e.g., 22 or 42). Further still, in some embodiments, a centerline of the third connection point (e.g., 113, 213, or 413) is within 20 degrees from a centerline of the cross tubes (e.g., 23).

Figure 6:
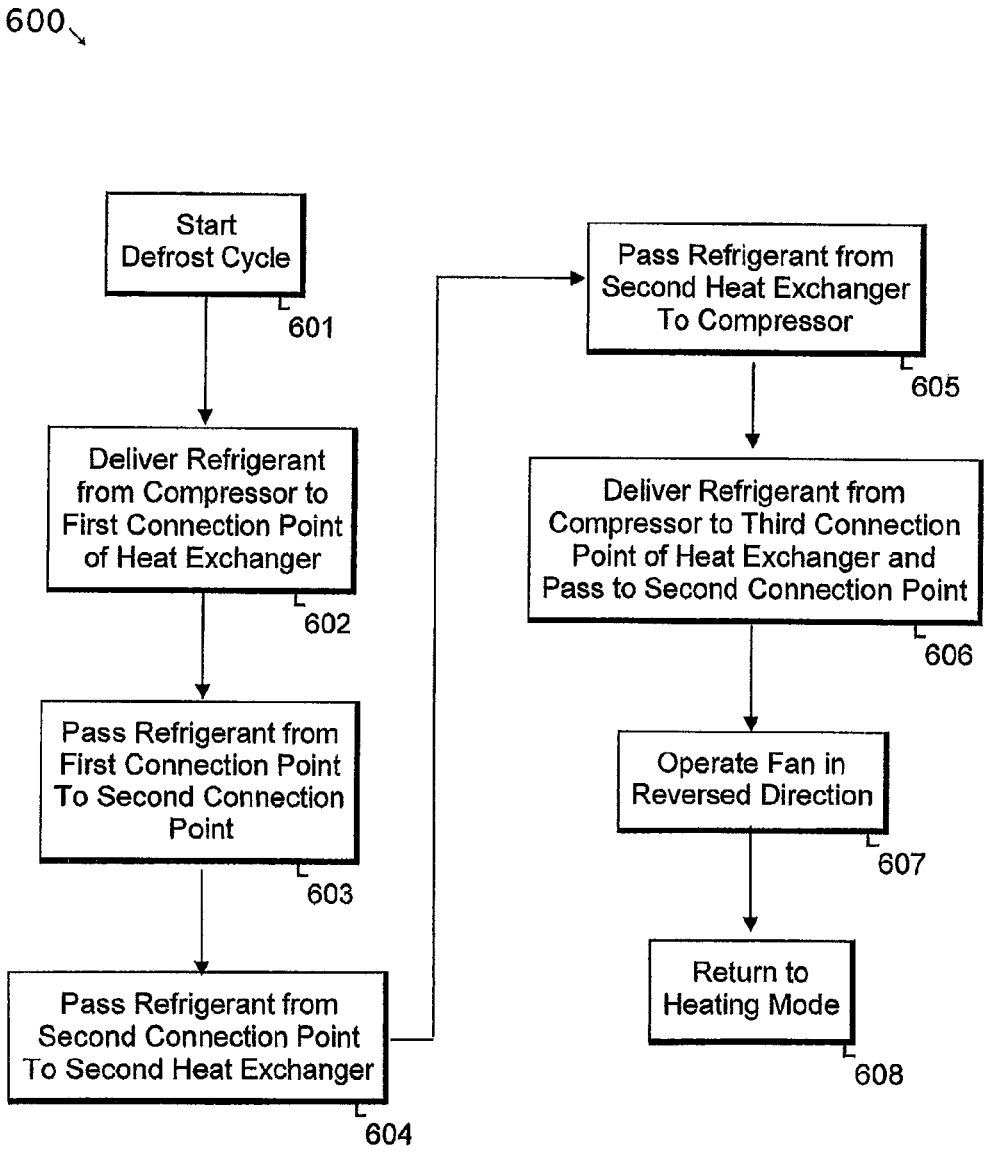
FIG. 6 is a flow chart illustrating an example of a method of defrosting a first heat exchanger of a heat pump and a method of improving the effectiveness of a defrost cycle of a heat pump.

FIG. 6 illustrates an example of various methods, method 600. Method 600 may be, for example, a method of defrosting a first heat exchanger (e.g., 11 shown in FIG. 1, 20 shown in FIG. 2, or 40 shown in FIG. 4) of a heat pump (e.g., 10 or 50 shown in FIGS. 1 and 5, respectively). Such a heat pump (e.g., 10 or 50) can include, for example, the first heat exchanger (e.g., 11, 20, or 40), a compressor (e.g., 13), at least one expansion device (e.g., 14), and a second heat exchanger (e.g., 12), for instance. Moreover, in certain embodiments, the first heat exchanger (e.g., 11, 20, or 40) includes (e.g., as shown in FIG. 2) a first header (e.g., 21), a second header (e.g., 22), and multiple cross tubes (e.g., 23) extending from the first header (e.g., 21) to the second header (e.g., 22). In a number of embodiments, for example, each of the cross tubes (e.g., 23) connects to the first header (e.g., 21) and to the second header (e.g., 22). In various embodiments, the first heat exchanger (e.g., 11, 20, or 40) includes a first connection point (e.g., 111, 2111, 2112, or 411), a second connection point (e.g., 112, 212, 4121, or 4122), and a third connection point (e.g., 113, 213, or 413). Further, in particular embodiments, the first connection point (e.g., 111, 2111, 2112, or 411) is to the first header (e.g., 21 or 41), the second connection point (e.g., 112, 212, 4121, or 4122), is to the second header (e.g., 22 or 42), and the third connection point (e.g., 113, 213, or 413) is also to the second header (e.g., 22 or 42).

In a number of embodiments, various methods include (e.g., in any order except where a particular order is explicitly indicated), at least certain acts. As used herein, "any order" includes acts being performed at the same time. The example of method 600, shown in FIG. 6, starts with act 601 of starting the defrost cycle. In a number of embodiments, the defrost cycle may be started by the control system (e.g., 16 shown in FIG. 1) or, in particular, by digital controller 160. In different embodiments, controller 160, for instance, may start the defrost cycle (e.g., act 601) based on one or more measured parameters, such as how long the heat pump (e.g., 10) has been operating, the outdoor air temperature, temperature of air at the first heat exchanger (e.g., 11, 20, or 40), the temperature of the first heat exchanger itself (e.g., 11, 20, or 40), system refrigerant pressure, a reading from a defrost sensor (e.g., 25 shown in FIG. 2), air low through the first heat exchanger (e.g., from sensor 185 shown in FIG. 1), whether (or the rate at which) the indoor air temperature has been changing (e.g., increasing), the temperature of second heat exchanger 12, or a combination thereof, as examples. Heat pump 10 or 50, or control system 16, as examples, may start the defrost cycle (e.g., act 601), for example, by switching reversing valve 150 from a heating mode to a defrost mode. In a number of embodiments, fan 18 may also be turned off or reversed, which is described in more detail below. The indoor air fan or second fan (e.g., 19) may stay on and the compressor (e.g., 13) may stay on as well. If not already on, indoor air fan or second fan (e.g., 19) and the compressor (e.g., 13) may start. Method 600, for example, in act 601, can include operating the heat pump (e.g., 10 or 50) in a defrost mode during a defrost cycle.

In the embodiment illustrated, method 600 also includes act 602 of delivering refrigerant from the compressor (e.g., 13) to the first connection point (e.g., 111 shown in FIG. 1, 2111 and 2112 shown in FIG. 2 and FIG. 5, or 411 shown in FIG. 4) of the first heat exchanger (e.g., 11, 20, or 40). Refrigerant may be delivered (e.g., in act 602), through refrigerant conduit 101 or 201, for example, by operating compressor 13. Method 600 also includes, in the embodiment shown, act 603 of (e.g., during the defrost cycle started in act 601) passing the refrigerant, for instance, through the first heat exchanger (e.g., 11, 20, or 40), from the first connection point (e.g., 111, 2111 and 2112, or 411), to the second connection point (e.g., 112, 212, or 4121 and 4122) of the first heat exchanger, (e.g., 11, 20, or 40). Referring to FIG. 2, in act 603, the refrigerant may pass through the multiple cross tubes (e.g., 23), the first header (e.g., 21), the second header (e.g., 22), or a combination thereof, for example.

In this particular embodiment, method 600 also includes act 604 of (e.g., during the defrost cycle), passing the refrigerant from the second connection point (e.g., 112 shown in FIG. 1, 212 shown in FIG. 2 and FIG. 5, or 4121 and 4122 shown in FIG. 4,) of the first heat exchanger (e.g., 11, 20, or 40) to the second heat exchanger (e.g., 12). Referring to FIG. 1, refrigerant may be passed (e.g., in act 604), through refrigerant conduits 102 and 104, for example. In a number of embodiments, the refrigerant may pass from the second connection point (e.g., 112 shown in FIG. 1) of the first heat exchanger (e.g., 11), through the at least one expansion device (e.g., 17, 14, or both), and then to the second heat exchanger (e.g., 12). Furthermore, in the embodiment shown, method 600 includes (e.g., during the defrost cycle started in act 601) act 605 of passing the refrigerant from the second heat exchanger (e.g., 12) to the compressor (e.g., 13). Referring to FIG. 1, refrigerant may be passed (e.g., in act 605), through refrigerant conduits 105 and 106, for example. In the embodiment shown in FIG. 1, in act 605, the refrigerant also passes through reversing valve 150 and accumulator 170 between second heat exchanger 12 and inlet port 132 on compressor 13. In various embodiments, the refrigerant may pass through the second heat exchanger (e.g., 12), and then back to the compressor (e.g., 13).

In a number of embodiments, acts 602 to 605 may take place at the same time. Further, acts 602 to 605 may take place, in some embodiments, starting during act 601, for example, when act 601 begins. Moreover, where refrigerant is described as passing through one component and then another component, refrigerant may be passing through both components at the same time, but the word "then" indicates that the one component is located upstream from the other component. In the embodiment illustrated, method 600, shown in FIG. 6, also includes act 606 of (e.g., during at least part of the defrost cycle), delivering refrigerant from the compressor (e.g., 13) to the third connection point (e.g., 113, 213, or 413) of the first heat exchanger (e.g., 11, 20, or 40), and passing the refrigerant from the third connection point (e.g., 113, 213, or 413), to the second connection point (e.g., 112, 212, or 4121 and 4122). In some embodiments, the refrigerant may pass, in act 606, through the second header (e.g., 22 or 42), for example. Act 606 can include, or can be performed by, in the embodiment illustrated, opening defrost valve 15 shown in FIGS. 1, 2, 4, and 5. In the embodiment shown, part of the refrigerant from compressor 13 goes through defrost valve 15 and third connection point 113, 213, or 413, (and then through part of the first heat exchanger) and part of the refrigerant from compressor 13 goes through first connection point 111, 2111 and 2112, or 411, and then though the first heat exchanger (e.g., during act 606). Thus, in the embodiment illustrated, act 606 is performed during part (or, in certain embodiments, all) of act 602.

Concerning acts 602 and 606, for example, as used herein, operating in a defrost mode or in a defrost cycle, to defrost the first heat exchanger, requires that the refrigerant be delivered from the compressor (e.g., 13) to the first heat exchanger (e.g., 11, 20, or 40) without the refrigerant passing through the second heat exchanger (e.g., 12) between the compressor and the first heat exchanger. Consequently, the refrigerant is hot when it reaches the first heat exchanger to defrost the first heat exchanger. The refrigerant can pass through other components, however, between the compressor and the first heat exchanger, such as reversing valve 150 shown in FIG. 1, where some incidental heat transfer and cooling of the hot refrigerant may take place. The refrigerant delivered in acts 602 and 606 may be hot, high-pressure gas, in a number of embodiments. Further, in various embodiments, at least some of the refrigerant gas may give up heat and condense in the first heat exchanger in act 603 act 606, or both. The refrigerant then drops from high pressure to low pressure at expansion device 14, in the embodiment illustrated, in act 604. This drop from high pressure to low pressure at expansion device 14 in act 604 causes at least some of the refrigerant to change from liquid to vapor (to boil) and become significantly cooler. More of the refrigerant may change from liquid to vapor (boil) as the refrigerant passes through the second heat exchanger 12, for example, absorbing heat from the space, before returning to compressor 13 in act 605.

In various embodiments, the heat pump can include a first fan (e.g., 18 shown in FIG. 1) that moves air (e.g., outdoor air) through the first heat exchanger (e.g., 11, 20, or 40). In the particular embodiment shown, method 600, shown in FIG. 6, also includes act 607 of operating the first fan (e.g., 18) in a reversed direction during at least part of the defrost cycle, for example, to reduce natural convection through the first heat exchanger (e.g., 11, 20, or 40). In various embodiments, the first fan can be operated, in the defrost cycle or in part of the defrost cycle, in a direction that blows air downward, to counteract natural convection that tends to move the warm air upward. In many embodiments, this is the reversed direction of rotation, but in other embodiments, it can be the forward direction of rotation, as another example.

In a number of embodiments, act 607 includes operating the first fan (e.g., 18) at a reduced or substantially reduced rate of speed (e.g., in the reversed direction) during the defrost cycle, in comparison with operation in the heating or cooling mode, for example. Moreover, in particular embodiments, the reduced or substantially reduced rate of speed can be accomplished in act 607 by intermittent operation (e.g., intermittent powering) or pulsing of power to the fan motor (e.g., 180), for instance, under the control of control system 16 or digital controller 160 (e.g., including programming instructions or software operating thereon). Reducing natural convection through the heat exchanger can result in the heat exchanger defrosting more effectively, more quickly, or both, for instance, at least under particular circumstances. Further, in certain embodiments, the fan (e.g., 18) may be operated, for instance, briefly, at a high speed in a forward or reversed direction (or both, alternately), for instance, at the end of the defrost cycle, to blow moisture, debris, or both from the heat exchanger or to dry the heat exchanger. Other embodiments, however, may omit this act of high-speed fan operation in the defrost cycle.

In different embodiments, acts 606, 607, or both, can be performed during all or part of the defrost cycle. For example, in certain embodiments, during a first portion of the defrost cycle, the refrigerant is not delivered to or passed through the third connection point (e.g., 113, 213, or 413). In other words, in this first portion of the defrost cycle, act 606 is not performed. The defrost valve (e.g., 15), for example, may remain closed during this first portion of the defrost cycle. Then during a second portion of the defrost cycle, this example of the method includes delivering and passing refrigerant through the third connection point (e.g., 113, 213, or 413), for instance, by opening the defrost valve (e.g., 15). Thus, act 606 is performed during the second portion of the defrost cycle, in this embodiment. During these different portions of the defrost cycle, different portions of the heat exchanger (e.g., 11, 20, or 40) are defrosted or defrosting is focused in those portions of the heat exchanger during these portions of the defrost cycle. In particular, in this example, in the case of heat exchanger 20 shown in FIG. 2, during the first portion of the defrost cycle, first header 21 and most of the length of cross tubes 23 are defrosted. Then during the second portion of the defrost cycle, second header 22 and the bottom ends of cross tubes 22 are defrosted or are defrosted more effectively. In other embodiments, the different portions of the heat exchanger may be defrosted in a different order, at the same time, or by alternating between a greater number of portions of the defrost cycle, as examples.

Furthermore, in different embodiments, the fan (e.g., 18) can be operated in the reversed direction (i.e., reversed in comparison with fan operation in the heating mode or the cooling mode) during all or part of the first portion of the defrost cycle, during all or part of the second portion of the defrost cycle, or both. In other words, in some embodiments, act 607 is performed during just part of the defrost cycle (e.g., started in act 601). In a number of embodiments, when the fan (e.g., 18) is not being operated in the reversed direction, the fan can be turned off. The speed of the fan (e.g., 18) in the reversed direction and the extent to which it is operated in the reversed direction, as opposed to being turned off, can be experimentally determined. In addition, the amount of time and sequence that the defrost valve is open or that hot refrigerant is delivered to the third connection point (e.g., 113, 213, or 413) can be experimentally determined. In other embodiments, however, feedback can be utilized to control one or more aspects of the defrost cycle. For example, in some embodiments, feedback from defrost sensor 25 shown in FIG. 2 can be used (e.g., by control system 16) to determine when to end (e.g., in act 608) a defrost cycle, when to open defrost valve 15, or both. In some embodiments, multiple defrost sensors may be provided at different locations in the first heat exchanger for such purposes. As another example, in some embodiments, feedback from a flow sensor (e.g., 185 shown in FIG. 1) can be used (e.g., by control system 16) to determine when (i.e., in the defrost cycle) or whether to operate fan 18 in the reversed direction, the speed to operate fan 18 (i.e., in the reversed direction) or both. For instance, in some embodiments, control system 16 adjusts the speed of first fan 18 to obtain a zero or near zero airflow rate at flow sensor 185 during all or part of the defrost cycle.

Referring to FIGS. 1, 2, and 5, as well as FIG. 6, in various embodiments, the second header (e.g., 22) of the first heat exchanger (e.g., 20) includes a first end (e.g., 271) and a second end (e.g., 272), each of the cross tubes (e.g., 23) connect to the second header (e.g., 22) between the first end (e.g., 271) and the second end (e.g., 272), the second connection point (e.g., 112 or 212) of the first heat exchanger (e.g., 11 or 20) is at the second end (e.g., 272) of the second header (e.g., 22), and the third connection point (e.g., 113 or 213) of the first heat exchanger (e.g., 11 or 20) is at the first end (e.g., 271) of the second header (e.g., 22). Moreover, in particular embodiments, act 603, which includes passing the refrigerant from the third connection point (e.g., 113 or 213), through the second header (e.g., 22), to the second connection point (e.g., 112 or 212), further includes passing the refrigerant from the first end (e.g., 271), through the second header (e.g., 22), to the second end (e.g., 272).

Referring to FIGS. 2, 3 and 5, in various methods, each cross tube (e.g., 23) includes multiple (e.g., contiguous, parallel, or both) refrigerant passageways (e.g., 33) therethrough. Moreover, in a number of embodiments, the first heat exchanger (e.g., 20) further includes multiple fins (e.g., 34) that can be located between the cross tubes (e.g., 23), that can be bonded to the cross tubes (e.g., 23), or both. Furthermore, in a number of embodiments, act 603 of passing the refrigerant through the first heat exchanger (e.g., 20) from the first connection point (e.g., 111 shown in FIG. 1 or 2111 and 2112 shown in FIG. 2), to the second connection point (e.g., 112 or 212) of the first heat exchanger (e.g., 11 or 20) includes heating the multiple fins (e.g., 34), for instance, between the cross tubes (e.g., 23). The fins may be heated, for example, to a temperature above freezing (i.e., above 32 degrees F. or 0 degrees C.), or to a higher temperature. In different embodiments, the fins may be heated to a temperature of 35, 40, 45, 50, 55, 60, 65, 70, 75, 80, 85, 90, 95, 100, 110, 120, 130, 140, or 150 degrees F., as examples, in act 603. In a number of embodiments, the temperature of different fins, or different parts of the same fin, may vary, and in various embodiments, the temperature that the fins reach may depend on ambient temperature, wind conditions, space temperature, the amount of frost present, other factors, or a combination thereof. In the embodiment illustrated, hot refrigerant from the compressor (e.g., 13) is passed (e.g., in act 603) through the multiple cross tubes (e.g., 23). Heat transfers from the refrigerant to the cross tubes (e.g., 23), and then by conduction to the fins (e.g., 34) to melt frost and ice from the fins.

In a number of embodiments, act 606, shown in FIG. 6, of delivering refrigerant from the compressor (e.g., 13 shown in FIGS. 1 and 5) to the third connection point (e.g., 113, 213, or 413 shown in FIGS. 1, 2, 4, and 5) of the first heat exchanger (e.g., 11, 20, or 40) includes opening a solenoid valve (e.g., defrost valve 15), for example, in a bypass refrigerant line (e.g., conduit 103), for instance, extending from a supply refrigerant line (e.g., conduit 101 or 201) connected to the first connection point (e.g., 111, 2111 and 2112, or 411). In particular such embodiments, the bypass refrigerant line (e.g., 103) extends, for example, to the third connection point (e.g., 113, 213, or 413). In different embodiments, the second header (e.g., 22 or 42) may be heated to a temperature of 35, 40, 45, 50, 55, 60, 65, 70, 75, 80, 85, 90, 95, 100, 110, 120, 130, 140, or 150 degrees F., as examples, in act 606. In a number of embodiments, the temperature may depend on ambient temperature, wind conditions, space temperature, the amount of frost present, other factors, or a combination thereof. In various embodiments, hot refrigerant from the compressor (e.g., 13) is passed (e.g., in act 606) through the second header (e.g., 22 or 42). Heat transfers from the refrigerant to the second header (e.g., 22 or 42), and then by conduction to the adjacent (e.g., lower) part of cross tubes 23 and to the fins (e.g., 34) bonded thereto to melt frost and ice from the second header, adjacent part of the cross tubes, and adjacent fins, for example.

Some methods include just a portion of the acts illustrated in method 600 in FIG. 6. Further, some embodiments may include additional acts not shown in FIG. 6. As examples, some methods include acts 601 to 606, but not act 607, and other methods include acts 601 to 605 and 607, but not act 606 (e.g., methods of improving the effectiveness of a defrost cycle of a heat pump by operating the outdoor air fan in a reversed direction to reduce natural convection through the outdoor heat exchanger). Other embodiments include all of acts 601 to 607, as another example. Other combinations and sub-combinations may be apparent to a person of ordinary skill in the art.

Further, various methods include act 608, shown in FIG. 6, of returning to the heating mode. Referring to FIG. 1, as used herein, such a heating mode (e.g., of act 608) means that the second heat exchanger (e.g., 12) is being heated by the refrigerant. In such a heating mode, as used herein, the first heat exchanger (e.g., 11) is being cooled by the refrigerant. In a number of HVAC applications, the first heat exchanger (e.g., 11) is located outdoors, or in outdoor air, and in the heating mode (e.g., returned to in act 608) the first heat exchanger is cooled by the refrigerant to a temperature below that of the outdoor air, and heat is transferred at the first heat exchanger (e.g., 11) from the outdoor air to the refrigerant. In freezers, however, the first heat exchanger (e.g., 11) can be located in the freezer, or air from the freezer can be blown through the first heat exchanger (e.g., 11) and returned to the freezer, and heat can be transferred from the freezer to the refrigerant, as another example. The heat pump (e.g., 10) may return to the heating mode (e.g., in act 608) after the defrost cycle is completed, for example, after the first heat exchanger (e.g., 11, 20, or 40) has been defrosted. In a number of embodiments, method 600 may be repeated when another defrost cycle is needed (e.g., when frost forms on the first heat exchanger, for example, 11, 20, or 40, for instance, as detected by frost sensor 25 shown in FIG. 2, or based on a decrease in air flow as determined by airflow sensor 185 shown in FIG. 1) or when frost has been deemed to have formed thereon (e.g., based on time of operation, one or more temperatures) or a combination thereof.

In a number of embodiments, act 608, of returning to the heating mode, may include, for example, switching reversing valve 150 (i.e., to the heating mode), and operating fan 18 in the normal forward direction. There can be a delay, in some embodiments, before fan 18 is started in the forward direction, for instance, until heat exchanger 11 becomes cold. Compressor 13 and indoor air fan or second fan 19 can continue to operate (e.g., through act 608), in a number of embodiments. On the other hand, if the thermostat does not call for heating, act 608 of returning to the heating mode may include turning off the unit until heating is demanded by the thermostat. Act 608 may be initiated by control system 16 or digital controller 160, for example.

As mentioned, certain embodiments include methods (e.g., 600), for example, of defrosting a first heat exchanger (e.g., 11, 20, or 40) of a heat pump (e.g., 10 or 50). Such a heat pump can include, for example, as described, the first heat exchanger, a compressor (e.g., 13), at least one expansion device (e.g., 14, 17, or both), and a second heat exchanger (e.g., 12). Moreover, the first heat exchanger can include, for example, headers (e.g., 21 and 22, or 41 and 42), multiple cross tubes (e.g., 23), a first connection point (e.g., 111, 2111, 2112, or 411) to the first heat exchanger, a second connection point (e.g., 112, 212, 4121, or 4122) to the first heat exchanger, and a third connection point (e.g., 113, 213, or 413) to the first heat exchanger. In a number of embodiments, such a method can include (e.g., in any order except where a particular order is explicitly indicated), at least certain acts. Such acts may include, for example, an act (e.g., starting in act 601) of operating the heat pump in a defrost mode during a defrost cycle, for instance, including delivering refrigerant (e.g., in act 602) from the compressor to the first connection point (i.e., of the first heat exchanger).

Such a method can also include, in various embodiments, acts of, (e.g., during the defrost cycle), passing the refrigerant (e.g., in act 603) through the first heat exchanger from the first connection point (i.e., the first connection point of the first heat exchanger), through the multiple cross tubes, to the second connection point (e.g., of the first heat exchanger). Such a method can further include, in certain embodiments, (e.g., also during the defrost cycle) passing the refrigerant (e.g., in act 604) from the second connection point (i.e., of the first heat exchanger), through the at least one expansion device (e.g., 14), and then to the second heat exchanger (e.g., 12). Such a method can also include, in a number of embodiments, acts of, (e.g., during the defrost cycle), passing the refrigerant through the second heat exchanger, and then back to the compressor (e.g., in act 605), and (e.g., during at least part of the defrost cycle) delivering at least part of the refrigerant from the compressor to the third connection point of the first heat exchanger (e.g., in act 606). Further, such a method can also include, in various embodiments, an act of, (e.g., during the defrost cycle), passing the at least part of the refrigerant from the third connection point (i.e., of the first heat exchanger), through one of the headers (e.g., header 22 or 42), to the second connection point (i.e., of the first heat exchanger), without passing the at least part of the refrigerant through any of the cross tubes (e.g., 23) of the first heat exchanger.

Further, in some such embodiments, the one of the headers (e.g., 22 or 42) of the first heat exchanger (e.g., 11, 20, or 40) includes a first end (e.g., 271) and a second end (e.g., 272), each of the cross tubes connect to the one of the headers between the first end and the second end, and the second connection point (e.g., 212) of the first heat exchanger is at the second end (e.g., 272) of the one of the headers (e.g., 22). Further still, in various embodiments, the third connection point (e.g., 113 or 213) of the first heat exchanger (e.g., 11 or 20) is at the first end (e.g., 271) of the one of the headers (e.g., 22), and the act (e.g., 606) of passing the refrigerant from the third connection point (i.e., of the first heat exchanger), through the one of the headers (e.g., 22), to the second connection point (e.g., 112 or 212) of the first heat exchanger includes passing the refrigerant from the first end (e.g., 271), through the one of the headers (e.g., 22), to the second end (e.g., 272). Even further, in some such embodiments, each cross tube (e.g., 23) includes multiple contiguous parallel refrigerant passageways (e.g., 33 shown in FIG. 3) therethrough, the first heat exchanger further includes multiple fins (e.g., 34) between the cross tubes that are bonded to the cross tubes, and the act (e.g., of passing the refrigerant through the first heat exchanger from the first connection point (i.e., of the first heat exchanger), through the multiple cross tubes, to the second connection point of the first heat exchanger (e.g., act 603) includes heating the multiple fins between the cross tubes.

In a number of embodiments, the act of delivering refrigerant from the compressor to the third connection point of the first heat exchanger (e.g., in act 606) includes opening a solenoid valve (e.g., 15) in a bypass refrigerant line (e.g., 103) extending from a supply refrigerant line (e.g., 101) connected to the first connection point (e.g., 111, 2111, 2112, or 411) of the first heat exchanger, the bypass refrigerant line (e.g., 103) extending to the third connection point (e.g., 113, 213, or 413) of the first heat exchanger. Moreover, in some embodiments, such a method includes, during a first portion of the defrost cycle, not passing refrigerant through the third connection point (e.g., 113, 213, or 413) of the first heat exchanger, and during a second portion of the defrost cycle, passing refrigerant through the third connection point (e.g., 113, 213, or 413) of the first heat exchanger. Furthermore, in certain embodiments, the headers consist of a first header (e.g., 21 or 41) and a second header (e.g., 22 or 42), the first connection point (e.g., 111, 2111, 2112, or 411) to the first heat exchanger is at the first header, the second connection point to the first heat exchanger (e.g., 112, 212, 4121, or 4122) is at the second header, and the third connection point to the first heat exchanger (e.g., 113, 213, or 413) is at the second header (e.g., 22 or 42). Further, in a number of such embodiments, the act (e.g., 606) of passing the at least part of the refrigerant from the third connection point, through one of the headers, to the second connection point includes passing the at least part of the refrigerant through the second header (e.g., 22 or 42) without passing the at least part of the refrigerant through any of the cross tubes (e.g., 23) of the first heat exchanger.

In various embodiments, the first heat exchanger (e.g., 11, 20, or 40) is an outdoor air heat exchanger, the second heat exchanger (e.g., 12) is an indoor air heat exchanger, the first heat exchanger includes a top (e.g., 28 or 48) and a bottom (e.g., 29 or 49), the first header (e.g., 21 or 41) extends across the top of the first heat exchanger, and the second header (e.g., 22 or 42) extends across the bottom of the first heat exchanger. Further, in some embodiments, each cross tube (e.g., 23) of the first heat exchanger includes multiple contiguous parallel refrigerant passageways (e.g., 33) therethrough, each of the multiple cross tubes directly connects to the first header, and each of the multiple cross tubes directly connects to the second header. Even further, in some embodiments, the first heat exchanger further includes multiple fins (e.g., 34) between the cross tubes that are bonded to the cross tubes, and the act (e.g., 603) of passing the refrigerant through the first heat exchanger from the first connection point (i.e., of the first heat exchanger), through the multiple cross tubes, to the second connection point (i.e., of the first heat exchanger) includes heating the multiple fins between the cross tubes. Even further still, in some embodiments, the act (e.g., in act 606) of delivering refrigerant from the compressor to the third connection point (i.e., of the first heat exchanger) includes opening a solenoid valve (e.g., 15) in a bypass refrigerant line (e.g., 103) extending from a supply refrigerant line (e.g., 101) connected to the first connection point (e.g., 111, 2111, 2112, or 411), the bypass refrigerant line extending to the third connection point (e.g., 13, 213, or 413).

Various embodiments of the subject matter described herein include various combinations of the acts, structure, components, and features described herein, shown in the drawings, or known in the art. Moreover, certain procedures may include acts such as obtaining or providing various structural components described herein, obtaining or providing components that perform functions described herein. Furthermore, various embodiments include advertising and selling products that perform functions described herein, that contain structure described herein, or that include instructions to perform functions described herein, as examples. Such products may be obtained or provided through distributors, dealers, or over the Internet, for instance. The subject matter described herein also includes various means for accomplishing the various functions or acts described herein or apparent from the structure and acts described.

What is claimed is:

1. A heat pump having an improved defrost cycle, the heat pump comprising:

a compressor;

at least one expansion device;

a first heat exchanger comprising:

a first header;

a second header; and multiple cross tubes extending from the first header to the second header, wherein:

each of the multiple cross tubes connects to the first header;

each of the multiple cross tubes connects to the second header;

the first header is parallel to the second header;

the multiple cross tubes are parallel to each other; and the multiple cross tubes each include multiple contiguous parallel refrigerant passageways therethrough;

multiple fins between the cross tubes wherein the fins are bonded to the cross tubes;

at least one first connection point to the first heat exchanger where refrigerant is delivered to the first heat exchanger from the compressor during the defrost cycle;

a second connection point to the first heat exchanger where refrigerant exits the first heat exchanger during the defrost cycle; and a third connection point to the first heat exchanger where refrigerant is delivered from the compressor to the first heat exchanger during at least part of the defrost cycle;

a first refrigerant conduit connecting a discharge port on the compressor to the at least one first connection point of the first heat exchanger;

a second refrigerant conduit connecting the second connection point of the first heat exchanger to the at least one expansion device;

a third refrigerant conduit connecting the first refrigerant conduit to the third connection point of the first heat exchanger;

a defrost valve located in the third refrigerant conduit between the first refrigerant conduit and the third connection point of the first heat exchanger, wherein, when the defrost valve is closed, refrigerant flow through the third refrigerant conduit is blocked; and a control system that controls the defrost valve and opens the defrost valve during the defrost cycle allowing refrigerant to flow through the third refrigerant conduit to the third connection point to the first heat exchanger;

wherein:

the first connection point to the first heat exchanger is at the first header;

the second connection point to the first heat exchanger is at the second header;

the third connection point to the first heat exchanger is at the second header;

refrigerant that, during at least part of the defrost cycle, passes through the third refrigerant conduit, through the defrost valve, and through the third connection point to the first heat exchanger, passes through the second header, heating the second header between the third connection point to the first heat exchanger and the second connection point to the first heat exchanger without passing through any cross tubes of the first heat exchanger;

the control system comprises a digital controller comprising programming instructions to open the defrost valve during the defrost cycle to defrost the first heat exchanger between the third connection point and the second connection point; and the digital controller further comprises programming instructions to keep the defrost valve closed when the heat pump is not in the defrost cycle.

2. The heat pump of claim 1 wherein the first heat exchanger comprises: a top and a bottom; and wherein the first header extends across the top of the first heat exchanger; the second header extends across the bottom of the first heat exchanger; the first header is horizontal; the second header is horizontal; and each of the multiple cross tubes directly connects to the first header, and directly connects to the second header.

3. The heat pump of claim 1 wherein the first heat exchanger consists essentially of:

the first header;

the second header;

the multiple cross tubes;

the multiple fins between the cross tubes, wherein the fins are bonded to the cross tubes;

the at least one first connection point to the first heat exchanger;

the second connection point to the first heat exchanger; and the third connection point to the first heat exchanger.

4. The heat pump of claim 1 further comprising an extension tube located within the second header, wherein:

the extension tube within the second header is substantially parallel to the second header; and the third connection point to the first heat exchanger is at the extension tube.

5. The heat pump of claim 1 wherein: the first heat exchanger has only two headers, the first header and the second header.

6. The heat pump of claim 1 wherein:

the second header has a first end and a second end;

each of the multiple cross tubes connects to the second header between the first end and the second end;

the second connection point to the first heat exchanger is at the second end of the second header; and the third connection point to the first heat exchanger is at the first end of the second header.

7. The heat pump of claim 6 wherein:

the first header has a third end and a fourth end;

each of the multiple cross tubes connects to the first header between the third end and the fourth end; and the at least one first connection point to the first heat exchanger consists of a single first connection point at the third end of the first header.

8. The heat pump of claim 6 wherein:

the first header has a third end and a fourth end;

each of the multiple cross tubes connects to the first header between the third end and the fourth end;

the at least one first connection point to the first heat exchanger comprises a primary first connection point to the heat exchanger at the third end of the first header and a secondary first connection point to the heat exchanger at the fourth end of the first header; and the first refrigerant conduit connects the discharge port on the compressor to the primary first connection point and to the secondary first connection point.

9. The heat pump of claim 1 wherein the digital controller further comprises programming instructions to keep the defrost valve closed during part of the defrost cycle to defrost the first heat exchanger between the at least one first connection point and the second connection point.

10. The heat pump of claim 1 further comprising a first fan positioned and configured to move air through the first heat exchanger, wherein the digital controller comprises programming instructions to operate the first fan in a reversed direction during at least part of the defrost cycle to reduce natural convection through the first heat exchanger during the at least part of the defrost cycle.

11. The heat pump of claim 1 further comprising a reversing valve located in the first refrigerant conduit between the discharge port on the compressor and the at least one first connection point of the first heat exchanger, wherein the third refrigerant conduit connects to the first refrigerant conduit between the reversing valve and the at least one first connection point of the first heat exchanger, the heat pump further comprising a second heat exchanger, a fourth refrigerant conduit connecting the at least one expansion device to the second heat exchanger, a fifth refrigerant conduit connecting the second heat exchanger to the reversing valve, and a sixth refrigerant conduit connecting the reversing valve to an inlet port on the compressor.

12. The heat pump of claim 1 wherein, during the defrost cycle, when the defrost valve is open: a first quantity of refrigerant passes from the compressor; and the defrost valve, the third refrigerant conduit, or both, are sized so that less than half of the first quantity of refrigerant from the compressor passes through the third connection point, and more than half of the first quantity of refrigerant from the compressor passes through the at least one first connection point.

13. The heat pump of claim 1 wherein a centerline of the third connection point is within 20 degrees from a centerline of the second header.

14. The heat pump of claim 1 wherein a centerline of the third connection point is within 20 degrees from a centerline of the cross tubes.

15. A method of defrosting a first heat exchanger of a heat pump, the heat pump comprising the first heat exchanger, a compressor, at least one expansion device, and a second heat exchanger, the first heat exchanger comprising headers, multiple cross tubes, a first connection point to the first heat exchanger, a second connection point to the first heat exchanger, and a third connection point to the first heat exchanger, the method comprising, in any order except where a particular order is explicitly indicated, at least the acts of:

operating the heat pump in a defrost mode during a defrost cycle including delivering refrigerant from the compressor to the first connection point of the first heat exchanger;

during the defrost cycle, passing the refrigerant through the first heat exchanger from the first connection point to the first heat exchanger, through the multiple cross tubes, to the second connection point of the first heat exchanger;

during the defrost cycle, passing the refrigerant from the second connection point of the first heat exchanger, through the at least one expansion device, and then to the second heat exchanger;

during the defrost cycle, passing the refrigerant through the second heat exchanger, and then back to the compressor; and during at least part of the defrost cycle, delivering at least part of the refrigerant from the compressor to the third connection point of the first heat exchanger; and passing the at least part of the refrigerant from the third connection point, through one of the headers, to the second connection point, without passing the at least part of the refrigerant through any of the cross tubes of the first heat exchanger.

16. The method of claim 15 wherein:

the one of the headers of the first heat exchanger comprises a first end and a second end;

each of the cross tubes connect to the one of the headers between the first end and the second end;

the second connection point of the first heat exchanger is at the second end of the one of the headers;

the third connection point of the first heat exchanger is at the first end of the one of the headers; and the act of passing the refrigerant from the third connection point, through the one of the headers, to the second connection point comprises passing the refrigerant from the first end, through the one of the headers, to the second end.

17. The method of claim 15 wherein:

each cross tube comprises multiple contiguous parallel refrigerant passageways therethrough;

the first heat exchanger further comprises multiple fins between the cross tubes that are bonded to the cross tubes; and the act of passing the refrigerant through the first heat exchanger from the first connection point, through the multiple cross tubes, to the second connection point of the first heat exchanger comprises heating the multiple fins between the cross tubes.

18. The method of claim 15 wherein the act of delivering refrigerant from the compressor to the third connection point of the first heat exchanger comprises opening a solenoid valve in a bypass refrigerant line extending from a supply refrigerant line connected to the first connection point, the bypass refrigerant line extending to the third connection point.

19. The method of claim 15 comprising, during a first portion of the defrost cycle, not passing refrigerant through the third connection point, and during a second portion of the defrost cycle, passing refrigerant through the third connection point.

20. The method of claim 15 wherein:

the headers consist of a first header and a second header;

the first connection point to the first heat exchanger is at the first header;

the second connection point to the first heat exchanger is at the second header;

the third connection point to the first heat exchanger is at the second header; and the act of passing the at least part of the refrigerant from the third connection point, through one of the headers, to the second connection point comprises passing the at least part of the refrigerant through the second header without passing the at least part of the refrigerant through any of the cross tubes of the first heat exchanger.

21. The method of claim 20 wherein:

the first heat exchanger is an outdoor air heat exchanger;

the second heat exchanger is an indoor air heat exchanger;

the first heat exchanger comprises a top and a bottom;

the first header extends across the top of the first heat exchanger;

the second header extends across the bottom of the first heat exchanger;

each cross tube of the first heat exchanger comprises multiple contiguous parallel refrigerant passageways therethrough;

each of the multiple cross tubes directly connects to the first header;

each of the multiple cross tubes directly connects to the second header;

the first heat exchanger further comprises multiple fins between the cross tubes that are bonded to the cross tubes;

the act of passing the refrigerant through the first heat exchanger from the first connection point, through the multiple cross tubes, to the second connection point of the first heat exchanger comprises heating the multiple fins between the cross tubes; and the act of delivering refrigerant from the compressor to the third connection point of the first heat exchanger comprises opening a solenoid valve in a bypass refrigerant line extending from a supply refrigerant line connected to the first connection point, the bypass refrigerant line extending to the third connection point.

22. A heat pump comprising:

a compressor;

at least one expansion device;

a first heat exchanger comprising a top and a bottom and consisting essentially of:

a first header extending across the top of the first heat exchanger;

a second header extending across the bottom of the first heat exchanger; and multiple cross tubes extending from the first header to the second header, wherein:

each of the multiple cross tubes is directly connected to the first header;

each of the multiple cross tubes is directly connected to the second header; and the multiple cross tubes each include multiple contiguous parallel refrigerant passageways therethrough;

multiple fins between the cross tubes wherein the fins are bonded to the cross tubes;

at least one first connection point where refrigerant is delivered to the first heat exchanger from the compressor during the defrost cycle;

a second connection point where refrigerant exits the first heat exchanger during the defrost cycle; and a third connection point where refrigerant is delivered from the compressor to the first heat exchanger during at least part of the defrost cycle;

a first fan positioned and configured to move air through the first heat exchanger;

a second heat exchanger;

a first refrigerant conduit connecting a discharge port on the compressor to the at least one first connection point of the first heat exchanger, wherein the first refrigerant conduit does not include any part of the first heat exchanger;

a reversing valve located in the first refrigerant conduit between the discharge port on the compressor and the at least one first connection point of the first heat exchanger;

a second refrigerant conduit connecting the second connection point of the first heat exchanger to the at least one expansion device, wherein the second refrigerant conduit does not include any part of the first heat exchanger;

a third refrigerant conduit connecting the first refrigerant conduit to the third connection point of the first heat exchanger;

a defrost valve located in the third refrigerant conduit between the first refrigerant conduit and the third connection point of the first heat exchanger, wherein, when the defrost valve is closed, refrigerant flow through the third refrigerant conduit is blocked; and a fourth refrigerant conduit connecting the at least one expansion device to the second heat exchanger;

a fifth refrigerant conduit connecting the second heat exchanger to the reversing valve;

a sixth refrigerant conduit connecting the reversing valve to an inlet port on the compressor;

a control system that controls the defrost valve and opens the defrost valve during the defrost cycle allowing refrigerant to flow through the third refrigerant conduit to the third connection point;

wherein:

the control system comprises a digital controller comprising programming instructions to open the defrost valve during the defrost cycle to defrost the first heat exchanger between the third connection point and the second connection point;

the digital controller further comprises programming instructions to keep the defrost valve closed when the heat pump is not in the defrost cycle;

the third refrigerant conduit connects to the first refrigerant conduit between the reversing valve and the at least one first connection point of the first heat exchanger;

the first connection point is at the first header;

the second connection point is at the second header;

the third connection point is at the second header; and refrigerant that, during at least part of the defrost cycle, passes through the third refrigerant conduit, through the defrost valve, and through the third connection point, passes through the second header, heating the second header between the third connection point and the second connection point without passing through any cross tubes of the first heat exchanger.

23. The heat pump of claim 22 wherein:

the second header has a first end and a second end;

each of the multiple cross tubes connects to the second header between the first end and the second end;

the second connection point to the first heat exchanger is at the second end of the second header; and the third connection point to the first heat exchanger is at the first end of the second header.

* * * * *